US009529289B2

(12) United States Patent
Abe et al.

(10) Patent No.: US 9,529,289 B2
(45) Date of Patent: Dec. 27, 2016

(54) METHOD FOR PRODUCING TONER PARTICLES

(71) Applicant: CANON KABUSHIKI KAISHA, Tokyo (JP)

(72) Inventors: Koji Abe, Numazu (JP); Toshihiko Katakura, Susono (JP); Akane Masumoto, Yokohama (JP); Tsuneyoshi Tominaga, Suntou-gun (JP); Shiro Kuroki, Suntou-gun (JP); Sara Inoue, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/746,078

(22) Filed: Jun. 22, 2015

(65) Prior Publication Data

US 2015/0378275 A1 Dec. 31, 2015

(30) Foreign Application Priority Data

Jun. 26, 2014 (JP) ..... 2014-131705
Jul. 1, 2014 (JP) ..... 2014-136334

(51) Int. Cl.
*G03G 9/093* (2006.01)
*G03G 9/08* (2006.01)

(52) U.S. Cl.
CPC ..... *G03G 9/0806* (2013.01); *G03G 9/081* (2013.01); *G03G 9/0804* (2013.01); *G03G 9/09328* (2013.01); *G03G 9/09392* (2013.01)

(58) Field of Classification Search
CPC ... G03G 9/0802; G03G 9/0804; G03G 9/0806
See application file for complete search history.

(56) References Cited

FOREIGN PATENT DOCUMENTS

| | | | | |
|---|---|---|---|---|
| JP | 58-072156 | * | 4/1983 | ..... G03G 9/08 |
| JP | 03-089361 A | | 4/1991 | |
| JP | 09-179341 A | | 12/1995 | |
| JP | 2001-75304 A | | 3/2001 | |
| JP | 2006-146056 A | | 6/2006 | |

OTHER PUBLICATIONS

Translation of JP 58-072156.*

* cited by examiner

*Primary Examiner* — Peter Vajda
(74) *Attorney, Agent, or Firm* — Canon U.S.A., Inc. IP Division

(57) ABSTRACT

A method is provided for producing toner particles containing an organosilicon polymer, produced by mixing an organosilicon compound and an aqueous medium containing base particles, and polymerizing the organosilicon compound. The organosilicon compound has a particular structure represented by formula (1) or (2). The organosilicon polymer is produced by polymerization at 80.0° C. or more and 105.0° C. or less.

8 Claims, 2 Drawing Sheets

METHOD FOR PRODUCING TONER PARTICLES

BACKGROUND OF THE INVENTION

Field of the Invention

The present invention relates to a method for producing a toner for developing electrostatic images (electrostatic latent images) for use in image-forming methods, such as electrophotography and electrostatic printing.

Description of the Related Art

With recent advances in computers and multimedia, there has been a demand for means for outputting high-definition full-color images in various fields, including offices and homes.

For business use involving frequent copy and printing, there is a demand for high endurance without deterioration of image quality even after many copies and prints are output. For use in small offices and homes, there is a demand for small apparatuses from the space-saving, energy-saving, and weight-saving perspectives, as well as a demand for high-quality images. In order to meet these demands, it is necessary to improve toner performance, such as environmental stability, soiling of components, low-temperature fixability, development endurance, and storage stability.

In particular, in the case of full-color images formed of superposed color toners, various color toners must be developed in the same manner, otherwise poor color reproduction and color non-uniformity occur. When a pigment or dye used as a colorant for toner is precipitated on the surface of toner particles, this may affect developability and cause color non-uniformity.

Fixability and color mixture properties are important in full-color images. For example, although binder resins suitable for low-temperature fixing are selected in order to meet the demand for high-speed printing, such binder resins greatly affect developability and endurance of color toners.

There is a demand for means for outputting high-definition full-color images for extended periods in different temperature and humidity environments. In order to meet such demands, it is necessary to reduce variations in the amount of electrical charge of toner and variations in toner surface properties due to different operating environments, such as temperature and humidity. It is also necessary to reduce soiling of components, such as a developing roller, a charging roller, a regulating blade, and a photosensitive drum. Thus, there is a demand for toners that have stable chargeability, cause no soiling of components, and have consistent development endurance even after long-term storage in various environments.

Variations in storage stability or in the amount of electrical charge of toner depending on the temperature and humidity can be caused by a release agent or a resin component of the toner bleeding from the interior to the surface of the toner (hereinafter also referred to simply as bleed) and changing the surface properties of the toner.

Such problems may be solved by a method for covering the surface of toner particles with resin.

Japanese Patent Laid-Open No. 2006-146056 discloses a toner having inorganic fine particles firmly adhered to the surface thereof as a toner having good high-temperature storage stability and printing endurance in a normal temperature and humidity environment or in high temperature and high humidity environments. However, even in the toner having inorganic fine particles firmly adhered to toner particles, a release agent or a resin component may bleed through a space between the inorganic fine particles, and the inorganic fine particles may detach from the surface due to degradation. Thus, the endurance of toner and soiling of components in severe environments should be further improved.

Japanese Patent Laid-Open No. 03-089361 discloses a method for producing a polymerized toner by adding a silane coupling agent to a reaction system in order to produce a toner that has no colorant or polar substance exposed on the surface thereof, has a narrow electrical charge distribution, and has the amount of electrical charge largely independent of humidity. However, in such a method, precipitation and hydrolytic polycondensation of a silane compound on the toner surface are insufficient, and environmental stability and development endurance need to be further improved.

Japanese Patent Laid-Open No. 09-179341 discloses a polymerized toner that contains a silicon compound in the form of a continuous thin film on the surface thereof in order to control the amount of electrical charge of the toner and to form high-quality print images at any temperature and at any humidity. However, the polymerized toner has a polar organic functional group, has insufficient precipitation and hydrolytic polycondensation of the silane compound on the surface thereof, and has a low degree of cross-linkage. Thus, it is necessary to reduce variations in image density due to variations in chargeability in high temperature and high humidity environments and to reduce soiling of components due to degradation.

Japanese Patent Laid-Open No. 2001-75304 discloses a polymerized toner having a covering layer formed by adhesion of agglomerates containing a silicon compound as a toner that has improved flowability, a less likelihood of separation of a fluidizer, improved low-temperature fixability, and improved blocking properties. In this polymerized toner, however, a release agent or a resin component may bleed through a space between the agglomerates containing the silicon compound. Furthermore, the silane compound may be insufficiently precipitated on the toner surface or may cause insufficient hydrolytic polycondensation. Thus, it is necessary to reduce variations in image density due to variations in chargeability in high temperature and high humidity environments, to reduce soiling of components due to toner melt adhesion, and to improve storage stability.

SUMMARY OF THE INVENTION

Aspects of the present invention provide a method for producing a toner having good development endurance, storage stability, environmental stability, resistance to soiling of components, and low-temperature fixability.

As a result of extensive studies, the present inventors arrived at the present invention by finding that the following structure can solve the problems described above.

The present invention provides a method for producing toner particles each of which has a surface layer, the layer containing an organosilicon polymer, wherein the method includes a step of forming the surface layer by providing an aqueous medium containing base particles, mixing an organosilicon compound and the aqueous medium, and polymerizing the organosilicon compound at a temperature of from 80.0° C. or more and 105.0° C. or less, wherein the organosilicon compound is represented by the following formula (1) or (2):

(1)

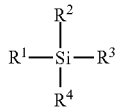

wherein $R^1$, $R^2$, $R^3$, and $R^4$ independently denote a hydrogen atom, a halogen atom, a hydroxy group, an amino group, or an alkoxy group, (2)

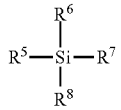

wherein $R^5$ denotes an alkyl group, an alkenyl group, or a phenyl group, and $R^6$, $R^7$, and $R^8$ independently denote a hydrogen atom, a halogen atom, a hydroxy group, an amino group, or an alkoxy group.

Further features of the present invention will become apparent from the following description of exemplary embodiments with reference to the attached drawings.

DESCRIPTION OF THE EMBODIMENTS

Figure 1:
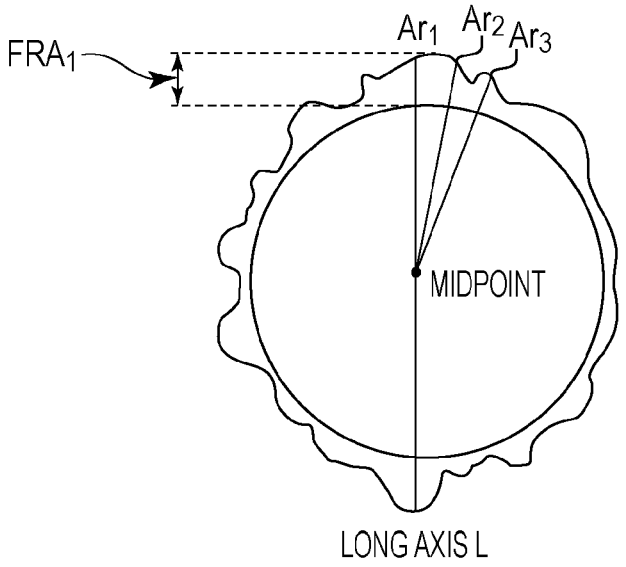
FIG. 1 is an explanatory view of a cross section of a toner particle observed with a TEM.

The present invention will be described in detail below. However, the present invention is not limited to the description.

A method for producing toner particles each of which has a surface layer, the layer containing an organosilicon polymer, wherein the method comprises a step of forming the surface layer by providing an aqueous medium containing base particles, mixing an organosilicon compound and the aqueous medium, and polymerizing the organosilicon compound at a temperature of from 80.0° C. or more and 105.0° C. or less, wherein the organosilicon compound is represented by the following formula (1) or (2):

(1)

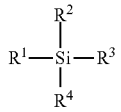

wherein $R^1$, $R^2$, $R^3$, and $R^4$ independently denote a hydrogen atom, a halogen atom, a hydroxy group, an amino group, or an alkoxy group, (2)

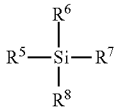

wherein $R^5$ denotes an alkyl group, an alkenyl group, or a phenyl group, and $R^6$, $R^7$, and $R^8$ independently denote a hydrogen atom, a halogen atom, a hydroxy group, an amino group, or an alkoxy group.

In an embodiment of the present invention, the surface layer containing the organosilicon polymer on the surface of toner particles can increase hydrophobicity due to the organic structure and improve the environmental stability of the toner.

The organosilicon polymer is produced by adding a polymerizable organosilicon compound to an aqueous medium containing base particles, or adding an aqueous medium containing base particles to a polymerizable organosilicon compound, and polymerizing the organosilicon compound. Because the toner particles contain the organosilicon polymer in the surface layer, the toner can have good storage stability and environmental stability. This is because the surface of the base particles can be uniformly covered with the organosilicon polymer. The organosilicon compound can be polymerized in the aqueous medium containing the base particles.

The organosilicon compound represented by the following formula (1) or (2) can improve environmental stability and endurance. Cross-linking due to hydrolytic polycondensation of the organosilicon compound represented by the formula (1) or (2) can improve endurance and environmental stability. Compounds represented by formula (2) can be used.

Examples of the organosilicon compound represented by the formula (1) include, but are not limited to, tetrafunctional silanes, including tetrahydrosilane, tetrachlorosilane, tetrahydroxysilane, tetraalkoxysilanes, such as tetramethoxysilane, tetraethoxysilane, tetrapropoxysilane, and tetrabutoxysilane, tetraisocyanatesilane, and tetraacetoxysilane.

Examples of the organosilicon compound represented by the formula (2) include, but are not limited to, trifunctional methylsilanes, such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane, trifunctional silanes, such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane, trifunctional phenylsilanes, such as phenyltrimethoxysilane, phenyltriethoxysilane, phenyltrichlorosilane, phenyltriacetoxysilane, and phenyltrihydroxysilane, trifunctional vinylsilanes, such as vinyltrimethoxysilane, vinyltriethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyldiacetoxymethoxysilane, vinyldiacetoxyethoxysilane, vinylacetoxydimethoxysilane, vinylacetoxymethoxyethoxysilane, vinylacetoxydiethoxysilane, vinyltrihydroxysilane, vinylmethoxydihydroxysilane, vinylethoxydihydroxysilane, vinyldimethoxyhydroxysilane, vinylethoxymethoxyhydroxysilane, and vinyldiethoxyhydroxysilane, and trifunctional allylsilanes, such as allyltrimethoxysilane, allyltriethoxysilane, allyldiethoxymethoxysilane, allylethoxydimethoxysilane, allyltrichlorosilane, allylmethoxydichlorosilane, allylethoxydichlorosilane, allyldimethoxychlorosilane, allylmethoxyethoxychlorosilane, allyldiethoxychlorosilane, allyltriacetoxysilane, allyldiacetoxymethoxysilane, allyldiacetoxyethoxysilane, allylacetoxydimethoxysilane, allylacetoxymethoxyethoxysilane, allylacetoxydiethoxysilane, allyltrihydroxysilane, allylmethoxydihydroxysilane, allylethoxydihydroxysilane, allyldimethoxyhydroxysilane, allylethoxymethoxyhydroxysilane, and allyldiethoxyhydroxysilane.

$R^1$, $R^2$, $R^3$, $R^4$, $R^6$, $R^7$, and $R^8$ in the formulae (1) and (2) independently denote a halogen atom, a hydroxy group, an acetoxy group, or an alkoxy group (hereinafter also referred to as a reactive group). Hydrolysis, addition polymerization, and condensation polymerization of these reactive groups form a cross-linked structure and can improve the resistance to soiling of components and development endurance of toner. An alkoxy group, such as a methoxy group or an ethoxy group, can be gently hydrolyzed and can be used in consideration of precipitation and coverage on the toner surface. Hydrolysis, addition polymerization, and condensation polymerization of $R^1$, $R^2$, $R^3$, $R^4$, $R^6$, $R^7$, and $R^8$ in the formulae (1) and (2) can be controlled via the reaction temperature, reaction time, reaction solvent, and pH.

An alkyl group, an alkenyl group, and a phenyl group of $R^5$ in the formula (2) can improve environmental stability.

The number of carbon atoms of $R^5$ can be 6 or less. $R^5$ may be a methyl group, an ethyl group, a propyl group, butyl group, a pentyl group, a hexyl group, a vinyl group, an allyl group, or a phenyl group, in particular, a methyl group, an ethyl group, a propyl group, or a phenyl group. However, variations in the amount of electrical charge in various environments tend to increase with the hydrophobicity of $R^5$. In particular, an alkyl group having 1 to 3 carbon atoms results in high environmental stability.

In an embodiment of the present invention, when $R^5$ denotes an alkyl group having 1 to 3 carbon atoms, chargeability and prevention of fogging are further improved. Good chargeability results in good transferability and less untransferred toner, which can reduce soiling of a drum, a charging member, and a transfer member.

Examples of the alkyl group having 1 to 3 carbon atoms include, but are not limited to, a methyl group, an ethyl group, and a propyl group. From the perspective of environmental stability and storage stability, $R^5$ can be a methyl group.

Because of hydrophobicity and chargeability of $R^5$ in the formula (2), it is possible to reduce the bleed of components (for example, a low-molecular-weight (Mw 1000 or less) resin, a low-Tg (40° C. or less) resin, and a release agent) present within the toner rather than on the surface of the toner. This can improve agitation of the toner. Thus, the toner can have high storage stability and developability with small density variations in continuous printing.

In an embodiment of the present invention, the organosilicon polymer content of the toner particles is preferably 0.25% or more and 50.00% or less by mass, more preferably 0.50% or more and 40.00% or less by mass.

The organosilicon compound is polymerized at an aqueous medium temperature of 80.0° C. or more and 105.0° C. or less. This results in hydrolytic polycondensation and cross-linking of the organosilicon compound represented by the formula (1) or (2), thereby improving endurance.

More preferably, the aqueous medium temperature is 85.0° C. or more and 100.0° C. or less. This improves environmental stability.

Base particles in an embodiment of the present invention can be any of particles A to D:

A. particles A produced by forming a polymerizable monomer composition containing a polymerizable monomer in an aqueous medium and polymerizing the polymerizable monomer composition;

B. particles B produced by melt-kneading and grinding a binder resin;

C. particles C produced by forming a dispersion liquid containing an organic phase dispersed in an aqueous medium, the organic phase containing a binder resin and an organic solvent; and D. particles D produced by agglomerating binder resin particles in an aqueous medium.

Use of the particles A to D as base particles improves soiling of components. The particles A, C, and D can be used in consideration of the dispersibility of the base particles in the aqueous medium. The particles A and C may contain a polymerizable monomer or an organic solvent.

In an embodiment of the present invention, the organosilicon compound can be polymerized while the aqueous medium is maintained at a pH of 4.0 or more and 10.0 or less.

Hydrolysis and condensation are promoted at a pH of 4.0 or more and 10.0 or less, preferably 6.0 or more and 9.5 or less. Cross-linking due to hydrolytic polycondensation can improve endurance and environmental stability.

In an embodiment of the present invention, the organosilicon compound represented by the formula (1) or (2) may be used in combination with an organosilicon compound having two reactive groups per molecule represented by the following formula (3) (bifunctional silane) or an organosilicon compound having one reactive group represented by the following formula (4) (monofunctional silane), provided that the advantages of the present invention are not significantly reduced.

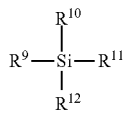
(3)

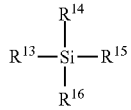
(4)

$R^{11}$, $R^{12}$, and $R^{16}$ independently denote a hydrogen atom, a halogen atom, a hydroxy group, an amino group, or an alkoxy group. $R^9$, $R^{10}$, $R^{13}$, $R^{14}$, and $R^{15}$ independently denote an alkyl group, an alkenyl group, a phenyl group, a 3-glycidoxypropylmethyl group, a 3-methacryloxypropylmethyl group, a 3-mercaptopropyl group, a 3-aminopropyl group, a 3-phenylaminopropyl group, or a 3-(2-aminoethyl) aminopropyl group.

Examples of such an additional organosilicon compound include, but are not limited to, dimethyldiethoxysilane, hexamethyldisilazane, 3-glycidoxypropylmethyldiethoxysilane, 3-methacryloxypropylmethyldimethoxysilane, 3-mercaptopropylmethyldimethoxysilane, 3-glycidoxypropylmethyldimethoxysilane, 3-glycidoxypropylmethyldimethoxysilane, hexamethyldisilane, t-butyldimethylchlorosilane, t-butyldimethylmethoxysilane, t-butyldimethylethoxysilane, t-butyldiphenylchlorosilane, t-butyldiphenylmethoxysilane, t-butyldiphenylethoxysilane, chloro(decyl)dimethylsilane, methoxy(decyl)dimethylsilane, ethoxy(decyl)dimethylsilane, chlorodimethylphenylsilane, methoxydimethylphenylsilane, ethoxydimethylphenylsilane, chlorotrimethylsilane, methoxytrimethylsilane, ethoxytrimethylsilane, triphenylchlorosilane, triphenylmethoxysilane, triphenylethoxysilane, chloromethyl(dichloro)methylsilane, chloromethyl(dimethoxy)methylsilane, chloromethyl(diethoxy) methylsilane, di-tert-butyldichlorosilane, di-tert-butyldimethoxysilane, di-tert-butyldiethoxysilane, dibutyldichlorosilane, dibutyldimethoxysilane, dibutyldiethoxysilane, dichlorodecylmethylsilane, dimethoxydecylmethylsilane, diethoxydecylmethylsilane, dichlorodimethylsilane, dimethoxydimethylsilane, diethoxydimethylsilane, dichloro(methyl)-n-octylsilane, dimethoxy(methyl)-n-octylsilane, and diethoxy(methyl)-n-octylsilane.

In an embodiment of the present invention, the ratio of NTX to NSi is preferably 50% or more and 100% or less, more preferably 60% or more and 100% or less, wherein NTX is the total number of silicon atoms in partial structures of the organosilicon polymer represented by the following formulae (TX1) to (TX3), and NSi is the total number of silicon atoms in the organosilicon polymer. When the ratio of NTX to NSi is 50% or more, this improves flowability and environmental stability of the toner and reduces density variations in continuous printing of a solid image (toner bearing amount: 0.40 mg/cm$^{2)}$. The partial structures of the organosilicon polymer represented by the following formulae (TX1) to (TX3) are formed by polymerizing the organosilicon compound represented by the formula (2).

The TX1, TX2, and TX3 structures are illustrated below. The TX1, TX2, and TX3 structures are collectively referred to as a TX structure.

(TX1)

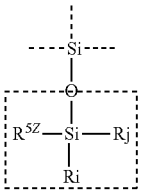

(TX2)

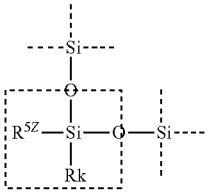

-continued (TX3)

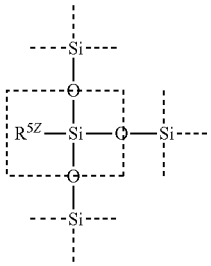

Ri, Rj, and Rk independently denote a hydrogen atom, a halogen atom, a hydroxy group, an amino group, or an alkoxy group. $R^{5Z}$ denotes an alkyl group, an alkenyl group, a polymer of the alkenyl group, or a phenyl group.

A typical method for producing an organosilicon polymer according to an embodiment of the present invention is a sol-gel method. In the sol-gel method, a metal alkoxide M(OR)n (M: metal, O: oxygen, R: an alkyl group, n: the oxidation number of the metal) is used as a starting material. The metal alkoxide is subjected to hydrolysis and condensation polymerization in a solvent and is transformed into a gel via a sol state. For example, the sol-gel method is used for the synthesis of glass, ceramics, organic-inorganic hybrids, and nanocomposites. Functional materials having various shapes, such as surface layers, fibers, bulks, and fine particles, can be produced by the method from a liquid phase at low temperatures.

More specifically, the organosilicon polymer in the surface layer of the toner particles can be formed by hydrolytic polycondensation of a silicon compound, such as an alkoxysilane.

Since the surface layer containing the organosilicon polymer uniformly covers the toner particles, unlike known toners, the toner has improved environmental stability without sticking or adhering inorganic fine particles to the toner. Furthermore, the toner is less prone to performance degradation during long-term use and has high storage stability.

Since a solution is transformed into a gel by the sol-gel method, materials having various fine structures and shapes can be produced. In particular, when the toner particles are produced in an aqueous medium, the hydrophilicity of a hydrophilic group, such as a silanol group, of the organosilicon compound facilitates precipitation on the surface of the toner particles. However, when the organosilicon compound has high hydrophobicity (for example, when the number of carbon atoms of the alkyl group of the organosilicon compound is more than 6), agglomerates having a diameter of one tenth or less the weight-average particle diameter (μm) of the toner particles tend to be formed on the surface of the toner particles. On the other hand, when the number of carbon atoms of the alkyl group of the organosilicon compound is zero, the toner has poor charging stability because of low hydrophobicity. The fine structure and shape can be adjusted via the reaction temperature, reaction time, reaction solvent, pH, and the type and amount of organosilicon compound.

It is known that the bonding state of the resulting siloxane bond generally depends on the acidity of the reaction medium in the sol-gel reaction. More specifically, in the case of acidic reaction media, a hydrogen ion undergoes electrophilic addition to an oxygen of one reactive group (for example, an alkoxy (—OR) group). Oxygen atoms of water molecules coordinate to silicon atoms and form hydrosilyl groups through a substitution reaction. In the presence of sufficient water, one $H^+$ attacks one oxygen of the reactive group (for example, an alkoxy (—OR) group), and a low $H^+$ content of the reaction medium results in a slow substitution reaction of the hydroxy group. Thus, a polycondensation reaction occurs before all of the reactive groups bonded to silane are hydrolyzed, and a one-dimensional linear polymer or a two-dimensional polymer is relatively easily formed.

In the case of alkaline reaction media, a hydroxide ion adds to silicon and forms a five-coordinate intermediate. Thus, all of the reactive groups (for example, an alkoxy (—OR) group) are easily desorbed and are easily substituted by a silanol group. In particular, when the silicon compound has 3 or more reactive groups bonded to the same silane, hydrolysis and polycondensation occur three-dimensionally, and an organosilicon polymer having many three-dimensional cross-links is formed. Furthermore, the reaction is completed in a short time.

Thus, the organosilicon polymer can be formed through a sol-gel reaction in an alkaline reaction medium. More specifically, the organosilicon polymer can be formed in an aqueous medium at a pH of 8.0 or more. The organosilicon polymer thus formed can have higher strength and endurance. The sol-gel reaction is preferably performed at a temperature of 90° C. or more for 5 hours or more.

Formation of coalesced particles composed of a silane compound in a sol or gel state on the surface of toner particles can be reduced in the sol-gel reaction at this reaction temperature and for this reaction time. The organosilicon compound may be used in combination with an organotitanium compound or an organoaluminum compound, provided that the advantages of the present invention are not significantly reduced.

Examples of the organotitanium compound include, but are not limited to, titanium methoxide, titanium ethoxide, titanium n-propoxide, tetra-i-propoxy titanium, tetra-n-butoxy titanium, titanium isobutoxide, titanium butoxide dimer, titanium tetra-2-ethylhexoxide, titanium diisopropoxy bis (acetylacetonate), titanium tetraacetylacetonate, titanium di-2-ethylhexoxy bis(2-ethyl-3-hydroxyhexoxide), titanium diisopropoxy bis(ethylacetoacetate), tetrakis(2-ethylhexyloxy)titanium, di-i-propoxy bis(acetylacetonato)titanium, titanium lactate, titanium methacrylate isopropoxide, triisopropoxy titanate, titanium methoxy propoxide, and titanium stearyloxide.

Examples of the organoaluminum compound include, but are not limited to, aluminum(III) n-butoxide, aluminum(III) s-butoxide, aluminum(III) s-butoxide bis(ethylacetoacetate), aluminum(III) t-butoxide, aluminum(III) di-s-butoxide ethylacetoacetate, aluminum(III) diisopropoxide ethylacetoacetate, aluminum(III) ethoxide, aluminum(III) ethoxyethoxy ethoxide, aluminum hexafluoropentanedionate, aluminum (III) 3-hydroxy-2-methyl-4-pyronate, aluminum(III) isopropoxide, aluminum-9-octadecenylacetoacetate diisopropoxide, aluminum(III) 2,4-pentanedionate, aluminum phenoxide, and aluminum(III) 2,2,6,6-tetramethyl-3,5-heptanedionate.

These compounds may be used alone or in combination. The amount of electrical charge can be altered by combining these compounds or by changing the amount of these compounds. In the electron spectroscopy for chemical analysis (ESCA) of a surface of toner particles of a toner according to an embodiment of the present invention, the ratio (dSi/[dSi+dO+dC]) of the silicon atom concentration dSi to the total (dSi+dO+dC) of the silicon atom concentration dSi, the oxygen atom concentration do, and the carbon atom concentration dC on the toner particle surface is preferably 2.5 atomic percent or more, more preferably 5.0 atomic percent or more, still more preferably 10.0 atomic percent.

ESCA is an elementary analysis for a surface having a thickness of several nanometers from the toner particle surface toward the center of the toner particle (a midpoint of a long axis). When the concentration of silicon atoms on the toner particle surface (dSi/[dSi+dO+dC]) is 2.5 atomic percent or more, the surface free energy can be decreased. When the concentration of silicon atoms is adjusted to be 2.5 atomic percent or more, the toner has improved flowability, and soiling of components and fogging can be further suppressed.

The concentration of silicon atoms on the toner particle surface (dSi/[dSi+dO+dC]) is preferably 33.3 atomic percent or less, more preferably 28.6 atomic percent or less, in terms of chargeability.

The concentration of silicon atoms on the toner particle surface can be controlled via the structure of $R^5$ in the formula (1) or (2) and via the method for producing toner particles, reaction temperature, reaction time, reaction solvent, and pH in the formation of the organosilicon polymer. The average thickness Dav. can also be controlled via the organosilicon polymer content. The term "a surface of a toner particle", as used herein, refers to a region having a thickness of 10.0 nm or less from the toner particle surface toward the center of the toner particle.

In an embodiment of the present invention, the average thickness Dav. of the surface layer containing the organosilicon polymer is preferably 5.0 nm or more and 150.0 nm or less as measured by the following method from the perspective of storage stability. The average thickness Dav. of the surface layer containing the organosilicon polymer in the toner particles is more preferably 7.5 nm or more and 125.0 nm or less, still more preferably 10.0 nm or more and 100.0 nm or less. When the average thickness Dav. of the surface layer containing the organosilicon polymer in the toner particles is in these ranges, the toner can have good storage stability, environmental stability, and low-temperature fixability.

In an embodiment of the present invention, the surface layer containing the organosilicon polymer can be in contact with a portion other than the toner particle surface layer (a core portion) with no space therebetween. In other words, the surface layer may not be a covering layer formed of agglomerates as disclosed in Japanese Patent Laid-Open No. 2001-75304. This can reduce the bleed of a resin component or a release agent from the inner portion of the toner particles surrounded by the surface layer containing the organosilicon polymer. Thus, the toner can have good storage stability, environmental stability, and development endurance.

[Average Thickness Dav. of Surface Layer Containing Organosilicon Polymer in Toner Particles]

The average thickness Dav. of the surface layer containing the organosilicon polymer in the toner particles is determined by the following method.

The average thickness $D^{(n)}$ of the surface layer containing the organosilicon polymer in one toner particle is determined by the following method.

In observation of a cross section of the toner particles with a transmission electron microscope (TEM), i) the longest chord in the cross section of the toner particle is taken as a long axis L, ii) one of line segments formed by dividing the long axis L at the midpoint thereof is denoted by a line segment a, and iii) 32 line segments drawn from the midpoint of the long axis L to the surface of the toner particle at intervals of 11.25 degrees with respect to the line segment a is denoted by $Ar_n$ (n=1 to 32).

Furthermore, the length of the surface layer along the $Ar_n$ (n=1 to 32) is denoted by $FRA_n$ (n=1 to 32).

$$D^{(n)}=(\text{Sum of } FRA_n(n=1 \text{ to } 32))/32$$

This calculation is performed for 10 toner particles. The average thickness Dav. of the surface layers containing the organosilicon polymer of the toner particles is calculated by averaging the thicknesses $D^{(n)}$ (n is an integer of 1 to 10) of the 10 toner particles using the following equation.

$$\text{Dav.}=\{D^{(1)}+D^{(2)}+D^{(3)}+D^{(4)}+D^{(5)}+D^{(6)}+D^{(7)}+D^{(8)}+D^{(9)}+D^{(10)}\}/10$$

The average thickness Dav. of the surface layer containing the organosilicon polymer in the toner particles can be controlled via the number of carbon atoms of the alkyl group and the number of hydrophilic groups in the formula (1) or (2). The average thickness Dav. of the surface layer containing the organosilicon polymer in the toner particles can be controlled via the reaction temperature, reaction time, reaction solvent, and pH of addition polymerization and condensation polymerization in the formation of the organosilicon polymer. The average thickness Dav. can also be controlled via the organosilicon polymer content.

In an embodiment of the present invention, the resulting toner particles or toner may be subjected to surface treatment with hot air. Surface treatment of toner particles or toner with hot air can promote condensation polymerization of an organosilicon compound in the vicinity of the surface of the toner particles and improve environmental stability and development endurance.

The surface treatment with hot air may be any treatment in which the surface of toner particles or toner can be treated with hot air, and the toner particles or toner treated with hot air can be cooled with cool air.

An apparatus for surface treatment with hot air may be a hybridization system (manufactured by Nara Machinery Co., Ltd.), a Mechanofusion system (manufactured by Hosokawa Micron Corporation), Faculty (manufactured by Hosokawa Micron Corporation), or Meteorainbow MR Type (manufactured by Nippon Pneumatic Mfg. Co., Ltd.).

Examples of aqueous media for use in these production methods include, but are not limited to, water, alcohols, such as methanol, ethanol, and propanol, and mixed solvents thereof.

The base particles can be produced by a suspension polymerization method for producing the particles A. In the suspension polymerization method, an organosilicon polymer tends to be uniformly precipitated on the surface of toner particles, thus resulting in good adhesion between the surface layer and the interior of the toner particles, and high storage stability, environmental stability, and development endurance. The suspension polymerization method will be further described below.

If necessary, a colorant, a release agent, a polar resin, and/or a low-molecular-weight resin may be added to the polymerizable monomer composition. After the organosilicon polymer layer is formed, the resulting particles are washed, are collected by filtration, and are dried to produce toner particles. The polymerization temperature may be increased in the latter half of the polymerization process. In order to remove unreacted polymerizable monomers or by-products, the dispersion medium may be partly evaporated from the reaction system in the latter half of the polymerization process or after the completion of the polymerization process. The following materials are used in another production method as well as the suspension polymerization method.

Examples of polymerizable monomers for use in the suspension polymerization method include, but are not limited to, the following polymerizable vinyl monomers: styrene; styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecyl styrene, p-methoxystyrene, and p-phenylstyrene; polymerizable acrylic monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphateethyl acrylate, diethylphosphateethyl acrylate, dibutylphosphateethyl acrylate, and 2-benzoyloxyethyl acrylate; polymerizable methacrylic monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphateethyl methacrylate, and dibutylphosphateethyl methacrylate; methylene aliphatic monocarboxylate esters; vinyl esters, such as vinyl acetate, vinyl propionate, vinyl benzoate, vinyl butyrate, vinyl benzoate, and vinyl formate; vinyl ethers, such as vinyl methyl ether, vinyl ethyl ether, and vinyl isobutyl ether; and vinyl methyl ketone, vinyl hexyl ketone, and vinyl isopropyl ketone. A polymerization initiator may be used in the polymerization of the polymerizable monomers. Examples of the polymerization initiator include, but are not limited to, azo and diazo polymerization initiators, such as 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and peroxide polymerization initiators, such as benzoyl peroxide, methyl ethyl ketone peroxide, diisopropyl peroxydicarbonate, cumene hydroperoxide, 2,4-dichlorobenzoyl peroxide, and lauroyl peroxide. These polymerization initiators may be used alone or in combination. The amount of polymerization initiator is preferably 0.5% or more and 30.0% or less by mass of the amount of the polymerizable monomers.

A chain transfer agent may be added in the polymerization of the polymerizable monomers in order to control the molecular weight of a binder resin constituting toner particles. The amount of chain transfer agent is preferably 0.001% or more and 15.000% or less by mass of the amount of the polymerizable monomers. A crosslinking agent may be added in the polymerization of the polymerizable monomers in order to control the molecular weight of a binder resin constituting toner particles. Examples of the crosslinking agent include, but are not limited to, divinylbenzene, bis(4-acryloxypolyethoxyphenyl)propane, ethylene glycol diacrylate and dimethacrylate, 1,3-butylene glycol diacrylate and dimethacrylate, 1,4-butanediol diacrylate and dimethacrylate, 1,5-pentanediol diacrylate and dimethacrylate, 1,6-hexanediol diacrylate and dimethacrylate, neopentyl glycol diacrylate and dimethacrylate, diethylene glycol diacrylate and dimethacrylate, triethylene glycol diacrylate and dimethacrylate, tetraethylene glycol diacrylate and dimethacrylate, diacrylates and dimethacrylates of poly(ethylene glycol) #200, #400, and #600, dipropylene glycol diacrylate and dimethacrylate, poly(propylene glycol) diacrylate and dimethacrylate, and polyester diacrylates (MANDA Nippon Kayaku Co., Ltd.) and dimethacrylates.

Examples of polyfunctional crosslinking agents include, but are not limited to, pentaerythritol triacrylate, trimethylolethane triacrylate, trimethylolpropane triacrylate, tetramethylolmethane tetraacrylate, oligoester acrylates and methacrylates, 2,2-bis(4-methacryloxy•polyethoxyphenyl) propane, diacryl phthalate, triallyl cyanurate, triallyl isocyanurate, triallyl trimellitate, and diallyl chlorendate. The amount of crosslinking agent is preferably 0.001% or more and 15.000% or less by mass of the amount of the polymerizable monomers. When an aqueous medium is used in the polymerization of the polymerizable monomers, the following dispersion stabilizers can be used for particles of the polymerizable monomer composition in the aqueous medium.

Examples of inorganic dispersion stabilizers include, but are not limited to, tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Examples of organic dispersion stabilizers include, but are not limited to, poly(vinyl alcohol), gelatin, methylcellulose, methylhydroxypropylcellulose, ethylcellulose, carboxymethylcellulose sodium salts, and starch.

Commercially available nonionic, anionic, and cationic surfactants can also be used. Examples of such surfactants include, but are not limited to, sodium dodecyl sulfate, sodium tetradecyl sulfate, sodium pentadecyl sulfate, sodium octyl sulfate, sodium oleate, sodium laurate, and potassium stearate.

In an embodiment of the present invention, when the aqueous medium is produced using a poorly water-soluble inorganic dispersion stabilizer, the amount of the dispersion stabilizer is preferably 0.2 parts or more and 2.0 parts or less by mass per 100.0 parts by mass of the polymerizable monomers. The aqueous medium is preferably produced using 300 parts or more and 3,000 parts or less by mass of water per 100 parts by mass of the polymerizable monomer composition.

In an embodiment of the present invention, when such an aqueous medium in which a poorly water-soluble inorganic dispersant is dispersed is produced, a commercially available dispersion stabilizer may be used directly. In order to obtain a dispersion stabilizer having a small uniform particle size, a poorly water-soluble inorganic dispersant may be produced in a liquid medium, such as water, while stirring at high speed. More specifically, when tricalcium phosphate is used as a dispersion stabilizer, aqueous sodium phosphate and aqueous calcium chloride can be mixed while stirring at high speed to form tricalcium phosphate fine particles as a dispersion stabilizer. In an embodiment of the present invention, the binder resin for use in toner particles may be, but is not limited to, a known binder resin. The binder resin for use in toner particles may be a vinyl resin or polyester resin. The vinyl resin can be produced by polymerization of at least one of the polymerizable vinyl monomers. For example, vinyl resins have high environmental stability. The vinyl resin can be an organosilicon polymer produced by polymerization of an organosilicon compound having the structure represented by the formula (1) or (2) in consideration of precipitation on the toner particle surface, surface uniformity, and long-term storage stability.

The polyester resin can be produced by condensation polymerization of the following carboxylic acid component and alcohol component.

Examples of the carboxylic acid component include, but are not limited to, terephthalic acid, isophthalic acid, phthalic acid, fumaric acid, maleic acid, cyclohexanedicarboxylic acid, and trimellitic acid.

Examples of the alcohol component include, but are not limited to, bisphenol A, hydrogenated bisphenol, ethylene oxide adducts of bisphenol A, propylene oxide adducts of bisphenol A, glycerin, trimethylolpropane, and pentaerythritol.

The polyester resin may be a polyester resin having a urea group.

Examples of the vinyl resin, the polyester resin, and other binder resins include, but are not limited to, the following resins and polymers.

Homopolymers of styrene and its substitution products, such as polystyrene and polyvinyltoluene; styrene copolymers, such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate copolymers; and poly(methyl methacrylate), poly(butyl methacrylate), poly(vinyl acetate), polyethylene, polypropylene, poly(vinyl butyral), silicone resin, polyamide resin, epoxy resin, polyacrylic resin, rosin, modified rosin, terpene resin, phenolic resin, aliphatic and alicyclic hydrocarbon resin, and aromatic petroleum resin. These binder resins may be used alone or in combination.

In a toner according to an embodiment of the present invention, the resin may have a polymerizable functional group in order to improve the viscosity change of the toner at high temperatures. Examples of the polymerizable functional group, include, but are not limited to, a vinyl group, an isocyanate group, an epoxy group, an amino group, a carboxy group, and a hydroxy group. In an embodiment of the present invention, the toner particles may contain a polar resin. The polar resin can be a saturated or unsaturated polyester resin.

The polyester resin can be produced by condensation polymerization of the following carboxylic acid component and alcohol component.

Examples of the carboxylic acid component include, but are not limited to, terephthalic acid, isophthalic acid, phthalic acid, fumaric acid, maleic acid, cyclohexanedicarboxylic acid, and trimellitic acid.

Examples of the alcohol component include, but are not limited to, bisphenol A, hydrogenated bisphenol, ethylene oxide adducts of bisphenol A, propylene oxide adducts of bisphenol A, glycerin, trimethylolpropane, and pentaerythritol.

The polyester resin may be a polyester resin having a urea group.

In an embodiment of the present invention, the polar resin preferably has a weight-average molecular weight of 4,000 or more and less than 100,000. The polar resin content is preferably 3.0% or more and 70.0% or less by mass, more preferably 3.0% or more and 50.0% or less by mass, still more preferably 5.0% or more and 30.0% or less by mass, of the binder resin component in the toner particles. In an embodiment of the present invention, the materials of the toner particles can include a release agent. Examples of the release agent for use in the toner particles include, but are not limited to, petroleum wax and its derivatives, such as paraffin wax, microcrystalline wax, and petrolatum, montan wax and its derivatives, Fischer-Tropsch wax and its derivatives, polyolefin wax and its derivatives, such as polyethylene and polypropylene, natural wax and its derivatives, such as carnauba wax and candelilla wax, higher aliphatic alcohols, fatty acids, such as stearic acid and palmitic acid, and their compounds, acid amide wax, ester wax, ketones, hydrogenated castor oil and its derivatives, plant wax, animal wax, and silicone resin.

The derivatives include oxides, block copolymers with vinyl monomers, and graft modified materials.

The release agent content is preferably 5.0 parts or more and 20.0 parts or less by mass per 100.0 parts by mass of the binder resin or polymerizable monomers. In an embodiment of the present invention, the toner particles may contain a colorant. Examples of the colorant include, but are not limited to, the following known colorants.

Examples of yellow pigments include, but are not limited to, yellow iron oxide, condensed azo compounds, isoindolinone compounds, anthraquinone compounds, azo metal complexes, methine compounds, and allylamide compounds. Specific examples of yellow pigments include, but are not limited to, C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 109, C.I. Pigment Yellow 110, C.I. Pigment Yellow 111, C.I. Pigment Yellow 128, C.I. Pigment Yellow 129, C.I. Pigment Yellow 147, C.I. Pigment Yellow 155, C.I. Pigment Yellow 168, and C.I. Pigment Yellow 180.

Examples of orange pigments include, but are not limited to, permanent orange GTR, pyrazolone orange, vulcan orange, benzidine orange G, indanthrene brilliant orange RK, and indanthrene brilliant orange GK.

Examples of red pigments include, but are not limited to, condensed azo compounds, diketopyrrolopyrrole compounds, anthraquinone, quinacridone compounds, basic dye lake compounds, naphthol compounds, benzimidazolone compounds, thioindigo compounds, and perylene compounds. Specific examples of red pigments include, but are not limited to, C.I. Pigment Red 2, C.I. Pigment Red 3, C.I. Pigment Red 5, C.I. Pigment Red 6, C.I. Pigment Red 7, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Examples of blue pigments include, but are not limited to, copper phthalocyanine compounds and their derivatives, anthraquinone compounds, and basic dye lake compounds. Specific examples of blue pigments include, but are not limited to, C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of violet pigments include, but are not limited to, fast violet B and methyl violet lake.

Examples of green pigments include, but are not limited to, pigment green B, malachite green lake, and Final Yellow Green G. Examples of white pigments include, but are not limited to, zinc white, titanium oxide, antimony white, and zinc sulfide.

Examples of black pigments include, but are not limited to, carbon black, aniline black, nonmagnetic ferrite, magnetite, and black pigments composed of the yellow colorant, the red colorant, and the blue colorant. These colorants may be used alone or in combination and may be used in the form of solid solution.

In some toner production methods, attention should be paid to the polymerization inhibition effects of colorants and the migration of dispersion media. If necessary, the surface of colorants may be modified by surface treatment with a substance having no polymerization inhibition effect. In particular, dyes and carbon black often have polymerization inhibition effects, and therefore attention should be paid to the use of such dyes and carbon black.

A dye may be treated by adding a colored polymer, which is produced in advance by polymerization of a polymerizable monomer in the presence of the dye, to a polymerizable monomer composition. Carbon black may be treated in the same manner as the dye or may be treated with a substance that can react with a surface functional group of carbon black (for example, organosiloxane).

The colorant content is preferably 3.0 parts or more and 15.0 parts or less by mass per 100.0 parts by mass of the binder resin or polymerizable monomers. In an embodiment of the present invention, the toner particles may contain a charge control agent. The charge control agent may be a known charge control agent. In particular, the charge control agent can have high charging speed and maintain a constant amount of electrical charge. When toner particles are produced by a direct polymerization method, the charge control agent can have small polymerization inhibition effects and can be substantially free of substances soluble in aqueous media.

Examples of charge control agents that can negatively charge toner particles include, but are not limited to, organometallic compounds and chelate compounds, such as monoazo metallic compounds, acetylacetone metallic compounds, and aromatic oxycarboxylic acid, aromatic dicarboxylic acid, oxycarboxylic acid, and dicarboxylic acid metallic compounds. Other examples of charge control agents that can negatively charge toner particles include, but are not limited to, aromatic oxycarboxylic acids, aromatic mono and polycarboxylic acids, and their metal salts, anhydrides, esters, and phenol derivatives, such as bisphenols. Other examples of charge control agents that can negatively charge toner particles include, but are not limited to, urea derivatives, metal-containing salicylic acid compounds, metal-containing naphthoic acid compounds, boron compounds, quaternary ammonium salts, and calixarenes.

Examples of charge control agents that can positively charge toner particles include, but are not limited to, nigrosine and nigrosine modified with fatty acid metal salts; guanidine compounds; imidazole compounds; quaternary ammonium salts, such as tributylbenzylammonium-1-hydroxy-4-naphthosulfonate and tetrabutylammonium tetrafluoroborate, and their analogs including onium salts, such as phosphonium salts, and lake pigments thereof; triphenylmethane dyes and lake pigments thereof (examples of laking agents include phosphotungstic acid, phosphomolybdic acid, phosphotungstenmolybdic acid, tannic acid, lauric acid, gallic acid, ferricyanide, and ferrocyanide); higher fatty acid metal salt; and resin charge control agents.

These charge control agents may be used alone or in combination. Among these charge control agents, metal-containing salicylic acid compounds, particularly aluminum- or zirconium-containing salicylic acid compounds may be used. In particular, the charge control agent can be an aluminum 3,5-di-tert-butyl salicylate compound. The resin charge control agent can be a polymer having a sulfonic acid functional group. The polymer having a sulfonic acid functional group is a polymer or copolymer having a sulfonic acid group, a sulfonic acid salt group, or a sulfonic ester group.

The polymer or copolymer having a sulfonic acid group, a sulfonic acid salt group, or a sulfonic ester group may be a polymer compound having a sulfonic acid group on its side chain. In particular, the polymer or copolymer having a sulfonic acid group, a sulfonic acid salt group, or a sulfonic ester group may be a polymer compound, such as a styrene copolymer, a styrene-acrylate copolymer, or a styrene-methacrylate copolymer, in which an acrylamide monomer having a sulfonic acid group or a methacrylamide monomer having a sulfonic acid group constitutes 2% or more by mass of the polymer compound. The polymer compound has a glass transition temperature (Tg) of 40° C. or more and 90° C. or less. This improves charging stability at high humidity. The acrylamide monomer having a sulfonic acid group or the methacrylamide monomer having a sulfonic acid group preferably constitutes 5% or more by mass.

The acrylamide monomer having a sulfonic acid group or the methacrylamide monomer having a sulfonic acid group can be represented by the following general formula (X) and, more specifically, may be 2-acrylamide-2-methylpropanoic acid or 2-methacrylamide-2-methylpropanoic acid.

(X)

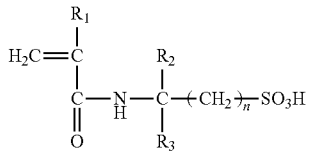

In the general formula (X), $R_1$ denotes a hydrogen atom or a methyl group, $R_1$ and $R_3$ independently denote a hydrogen atom, or an alkyl group, an alkenyl group, an aryl group, or an alkoxy group each having 1 to 10 carbon atoms, and n is an integer of 1 or more and 10 or less.

When the amount of polymer having a sulfonic acid group in the toner particles is 0.1 parts or more and 10.0 parts or less by mass per 100 parts by mass of the binder resin, the polymer can further improve the charging state of the toner particles.

The amount of the charge control agent is preferably 0.01 parts or more and 10.00 parts or less by mass per 100.00 parts by mass of the binder resin or polymerizable monomers. In order to impart various characteristics to a toner according to an embodiment of the present invention, the toner particle surface can be treated with various organic fine particles or inorganic fine particles to produce the toner. The organic fine particles or inorganic fine particles preferably have a particle size of one tenth or less the weight-average particle diameter of the toner particles in terms of endurance.

Examples of the organic fine particles or inorganic fine particles include, but are not limited to, (1) fluidity imparting agents: silica, alumina, titanium oxide, carbon black, and fluorocarbon, (2) abrasives: metal oxides, such as strontium titanate, cerium oxide, alumina, magnesium oxide, and chromium oxide, nitrides, such as silicon nitride, carbides, such as silicon carbide, and metal salts, such as calcium sulfate, barium sulfate, and calcium carbonate, (3) lubricants: fluoropolymer powders, such as vinylidene fluoride and polytetrafluoroethylene, and fatty acid metal salts, such as zinc stearate and calcium stearate, and (4) charge control particles: metal oxides, such as tin oxide, titanium oxide, zinc oxide, silica, and alumina, and carbon black.

The organic fine particles or inorganic fine particles on the surface of the toner particles improve toner flowability and make toner charging uniform. Hydrophobic treatment of the organic fine particles or inorganic fine particles can control toner chargeability and improve charging characteristics in high humidity environments. Thus, the organic fine particles or inorganic fine particles can be subjected to hydrophobic treatment. Examples of hydrophobic treatment agents for the organic fine particles or inorganic fine particles include, but are not limited to, unmodified silicone varnishes, modified silicone varnishes, unmodified silicone oils, modified silicone oils, silane compounds, silane coupling agents, organosilicon compounds, and organotitanium compounds. These treatment agents may be used alone or in combination.

In particular, the inorganic fine particles treated with silicone oil can be used. The inorganic fine particles can be subjected to a hydrophobic treatment with a coupling agent and simultaneously or subsequently with silicone oil. The inorganic fine particles hydrophobically treated with silicone oil can maintain a large amount of electrical charge of toner even in high humidity environments and reduce selective developability.

The amount of the organic fine particles or inorganic fine particles is preferably 0.01 parts or more and 10.00 parts or less by mass, more preferably 0.02 parts or more and 5.00 parts or less by mass, still more preferably 0.03 parts or more and 1.00 part or less by mass, per 100.00 parts by mass of the toner particles. Such a proper amount of organic fine particles or inorganic fine particles reduce soiling of components caused by burying of the organic fine particles or inorganic fine particles in the toner particles or by separation of the organic fine particles or inorganic fine particles from the toner particles. These organic fine particles or inorganic fine particles may be used alone or in combination. In an embodiment of the present invention, the organic fine particles or inorganic fine particles preferably have a BET specific surface area of 10 $m^2/g$ or more and 450 $m^2/g$ or less.

The specific surface area BET of the organic fine particles or inorganic fine particles can be determined by a low-temperature gas adsorption method and a dynamic constant pressure method according to a BET method (a BET multipoint method). For example, nitrogen gas is adsorbed on a surface of a sample in a specific surface area measuring apparatus "Gemini 2375 Ver. 5.0" (manufactured by Shimadzu Corporation), and the BET specific surface area ($m^2/g$) is determined by the BET multipoint method.

The organic fine particles or inorganic fine particles may be firmly stuck or adhered to the surface of toner particles. Examples of external addition and mixing apparatuses for firmly sticking or adhered the organic fine particles or inorganic fine particles to the toner particle surface include, but are not limited to, a Henschel mixer, Mechanofusion (trade name), Cyclomix (trade name), Turbulizer (trade name), Flexomix (trade name), Hybridization (trade name), Mechano Hybrid (trade name), and Nobilta (trade name). The organic fine particles or inorganic fine particles can be firmly stuck or adhered by increasing the peripheral speed or treatment time. The physical properties of toner will be described below.

A toner according to an embodiment of the present invention preferably has a viscosity of 1,000 Pa·s or more and 40,000 Pa·s or less at 80° C. as measured with a constant-load extrusion capillary rheometer. When the viscosity is 1,000 Pa·s or more and 40,000 Pa·s or less at 80° C., the toner has good low-temperature fixability. More preferably, the viscosity is 2,000 Pa·s or more and 20,000 Pa·s or less at 80° C. In an embodiment of the present invention, the viscosity at 80° C. can be adjusted via the amount of low-molecular-weight resin to be added, the type of monomer in the production of a binder resin, the amount of initiator, the reaction temperature, and the reaction time.

The viscosity of toner at 80° C. can be measured by the following method with a constant-load extrusion capillary rheometer.

A flow tester CFT-500D (manufactured by Shimadzu Corporation) is used under the following conditions.

Sample: Approximately 1.0 g of toner is pressed with a compression molding machine at a load of 100 kg/cm$^2$ for 1 minute to form a sample.

Die orifice diameter: 1.0 mm

Die length: 1.0 mm

Cylinder pressure: $9.807\times10^5$ (Pa)

Measurement mode: temperature rise method

Heating rate: 4.0° C./min

The viscosity (Pa·s) of toner is measured by the method at a temperature of 30° C. or more and 200° C. or less, and the viscosity (Pa·s) at 80° C. is determined. This value is taken as the viscosity of the toner measured with a constant-load extrusion capillary rheometer at 80° C.

A toner according to an embodiment of the present invention preferably has a weight-average particle diameter (D4) of 4.0 μm or more and 9.0 μm or less, more preferably 5.0 μm or more and 8.0 μm or less, still more preferably 5.0 μm or more and 7.0 μm or less. A toner according to an embodiment of the present invention preferably has a glass transition temperature (Tg) of 35° C. or more and 100° C. or less, more preferably 40° C. or more and 80° C. or less, still more preferably 45° C. or more and 70° C. or less. A glass transition temperature in this range results in improved blocking resistance, low-temperature offset resistance, and transparency of transmission images of overhead projector films.

The tetrahydrofuran-insoluble matter content of a toner according to an embodiment of the present invention is preferably less than 50.0% by mass, more preferably 0.0% or more and less than 45.0% by mass, still more preferably 5.0% or more and less than 40.0% by mass, of the toner components other than the colorant and inorganic fine particles. A THF-insoluble matter content of less than 50.0% by mass can result in improved low-temperature fixability.

The THF-insoluble matter content of the toner refers to the mass percentage of an ultra-high molecular weight polymer component (substantially a cross-linked polymer) insoluble in the THF solvent. In an embodiment of the present invention, the THF-insoluble matter content of toner is measured as described below.

1.0 g of toner is weighed (Wig), is placed in a filter paper thimble (for example, No. 86R manufactured by Toyo Roshi Kaisha, Ltd.), and is subjected to extraction for 20 hours in a Soxhlet extractor using 200 mL of THF as a solvent. Soluble components extracted by the solvent are concentrated. The concentrated soluble components are dried under vacuum at 40° C. for several hours, and THF-soluble resin components are weighed (W2g). The weight of components, such as a colorant, of the toner other than the resin component is denoted by W3g. The THF-insoluble matter content is calculated using the following equation.

$$THF\text{-insoluble matter content(\% by mass)}=\{(W1-(W3+W2))/(W1-W3)\}\times100$$

The THF-insoluble matter content of the toner can be adjusted via the degree of polymerization and the degree of cross-linkage of the binder resin.

The tetrahydrofuran (THF) soluble matter of a toner according to an embodiment of the present invention preferably has a weight-average molecular weight (Mw) (hereinafter also referred to as the weight-average molecular weight of the toner) of 5,000 or more and 50,000 or less as measured by gel permeation chromatography (GPC). When the weight-average molecular weight (Mw) of the toner is within this range, blocking resistance and development endurance as well as low-temperature fixability and high image gloss can be both satisfied. The weight-average molecular weight (Mw) of a toner according to an embodiment of the present invention can be adjusted via the amount and weight-average molecular weight (Mw) of a low-molecular-weight resin and via the reaction temperature, the reaction time, the amount of polymerization initiator, the amount of chain transfer agent, and the amount of cross-linking agent in the production of the toner particles.

The ratio [Mw/Mn] of the weight-average molecular weight (Mw) to the number-average molecular weight (Mn) of the tetrahydrofuran (THF) soluble matter of a toner according to an embodiment of the present invention is preferably 5.0 or more and 100.0 or less, more preferably 5.0 or more and 30.0 or less, in the molecular weight distribution measured by gel permeation chromatography (GPC). [Mw/Mn] within this range can result in a wide fixable temperature range.

Method for Measuring Physical Properties of Toner Particles or Toner

[Method for Separating Tetrahydrofuran (THF) Insoluble Matter from Toner Particles for NMR Measurement]

The tetrahydrofuran (THF) insoluble matter of toner particles is separated as described below.

10.0 g of toner particles are weighed, are placed in a filter paper thimble (No. 86R manufactured by Toyo Roshi Kaisha, Ltd.), and are subjected to extraction for 20 hours in a Soxhlet extractor using 200 mL of THF as a solvent. The filter residue in the filter paper thimble is dried at 40° C. under vacuum for several hours to obtain the THF-insoluble matter of the toner particles for NMR measurement. In an embodiment of the present invention, when the toner particle surface is treated with the organic fine particles or inorganic fine particles, the organic fine particles or inorganic fine particles are removed by the following method to obtain toner particles.

160 g of sucrose (manufactured by Kishida Chemical Co., Ltd.) is dissolved in 100 mL of ion-exchanged water in a vessel in hot water to prepare a concentrated sucrose solution. A centrifugation tube is charged with 31.0 g of the concentrated sucrose solution and 6 mL of Contaminon N (a 10% by mass aqueous neutral detergent for cleaning precision measuring instruments composed of a nonionic surfactant, an anionic surfactant, and an organic builder, pH 7, manufactured by Wako Pure Chemical Industries, Ltd.) to produce a dispersion liquid. 1.0 g of toner is added to the dispersion liquid, and agglomerates of toner are triturated with a spatula.

The centrifugation tube is shaken with a shaker at 350 strokes per min (spm) for 20 minutes. After shaking, the solution is transferred to a glass tube for a swing rotor (50 mL) and is centrifuged in a centrifugal separator at 3500 rpm for 30 min. Separation of the toner from the aqueous solution is visually inspected, and the toner in the top layer is collected with a spatula. The toner is filtered through a vacuum filter and is dried in a dryer for 1 hour or more. The dried toner is crushed with spatula to produce toner particles.

Method for Determining Partial Structure Represented by Formulae (1) and (2)

The partial structures represented by the formulae (1) and (2) of the organosilicon polymer in the toner particles are determined by the following method.

The presence of the alkyl group, alkenyl group, or phenyl group denoted by $R^5$ in the formula (2) is detected by $^{13}$C-NMR. The detailed structures represented by the formulae (1) and (2) are examined by $^{1}$H-NMR, $^{13}$C-NMR, and $^{29}$Si-NMR. The apparatus and measurement conditions are described below. Measurement Conditions Apparatus: AVANCE III 500 manufactured by Bruker Corporation Probe: 4 mm MAS BB/1H Measurement temperature: Room temperature Sample rotational speed: 6 kHz Sample: 150 mg of a sample (THF-insoluble matter of toner particles for NMR measurement) is placed in a sample tube having a diameter of 4 mm.

The presence of the alkyl group, alkenyl group, or phenyl group denoted by $R^5$ in the formula (2) is detected by this method. Detection of a signal indicates the "presence" of the structure represented by formulae (1) and (2). Measurement Conditions for $^{13}$C-NMR (Solid)

Measuring nuclear frequency: 125.77 MHz

Reference substance: Glycine (external standard: 176.03 ppm)

Measuring width: 37.88 kHz

Measurement method: CP/MAS

Contact time: 1.75 ms

Repetition time: 4 s

Number of scans: 2048

LB value: 50 Hz $^{29}$Si-NMR (Solid) Measurement Method

Measurement Conditions

Apparatus: AVANCE III 500 manufactured by Bruker Corporation

Probe: 4 mm MAS BB/1H

Measurement temperature: Room temperature

Sample rotational speed: 6 kHz

Sample: 150 mg of a sample (THF-insoluble matter of toner particles for NMR measurement) is placed in a sample tube having a diameter of 4 mm.

Measuring nuclear frequency: 99.36 MHz

Reference substance: DSS (external standard: 1.534 ppm)

Measuring width: 29.76 kHz

Measurement method: DD/MAS, CP/MAS $^{29}$Si 90 degrees pulse width: 4.00 μs@−1 dB Contact time: 1.75 to 10 ms Repetition time: 30 s (DD/MASS), 10 s (CP/MAS)

Number of scans: 2048

LB value: 50 Hz

An example of the chemical shift of a structure QX4 after the hydrolytic polycondensation of the structure represented by the formula (1)

(QX4)

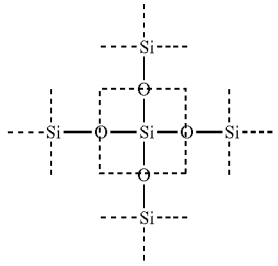

Chemical shift of structure QX4 by $^{29}$Si-NMR: −108 ppm

Method for Determining Partial Structure Represented by Formula (3) or (4)

The partial structure represented by the formula (3) or (4) can be determined in the same manner as in the partial structure represented by the formula (1) or (2). Method for calculating ratio of number of silicon atoms of TX1 structure, TX2 structure, and TX3 structure formed by polymerization of partial structure represented by formula (2) in organosilicon polymer to number of silicon atoms of organosilicon polymer The TX1 structure, TX2 structure, and TX3 structure formed by polymerization of the partial structure represented by the formula (2) in the organosilicon polymer can be determined by IR, $^{1}$H-NMR, $^{13}$C-NMR, and $^{29}$Si-NMR.

After $^{29}$Si-NMR measurement of the THF-insoluble matter of the toner particles, the peaks of a plurality of silane components having different substituents and bond groups in the toner particles are separated by curve fitting into the TX3 structure, in which 3.0 ($O_{1/2}$) atoms are bonded to silicon, the TX2 structure, in which 2.0 ($O_{1/2}$) atoms are bonded to silicon, and the TX1 structure, in which 1.0 ($O_{1/2}$) atom is bonded to silicon. The molar percentage of each component is calculated from the area ratio of the peaks.

Figure 2:
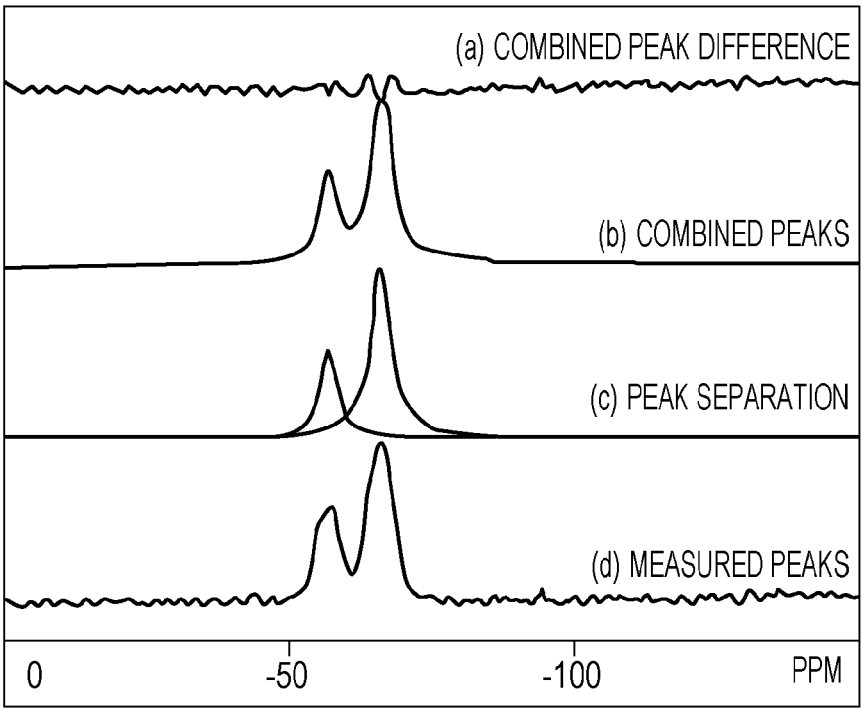
FIG. 2 is a $^{29}$Si-NMR chart of toner particles according to an embodiment of the present invention.

EXcalibur for Windows (registered trademark) version 4.2 (EX series) Software for JNM-EX400 manufactured by JEOL Ltd. is used for the curve fitting. Measured data are read by clicking "1D Pro" in the menu icons. "Curve fitting function" is selected from "Command" in the menu bar to perform the curve fitting. FIG. 2 shows an example. The peaks are separated so as to minimize the combined peak difference (a), which is the difference between combined peaks (b) and measured peaks (d). The total area STX1 of the TX1 structure, the total area STX2 of the TX2 structure, the total area STX3 of the TX3 structure, and the total area S of the organosilicon polymer are calculated by $^{29}$Si-NMR of the THF-insoluble matter of the toner particles.

In an embodiment of the present invention, the silane monomer is identified on the basis of the chemical shift, and the total peak area S of the organosilicon polymer is calculated by subtracting the peak area of the silane monomer component from the total peak area in the $^{29}$Si-NMR measurement of the toner particles.

Ratio of peak area STX1 of organosilicon having TX1 structure, peak area STX2 of organosilicon having TX2 structure, and peak area STX3 of organosilicon having TX3 structure formed by polymerization of partial structure represented by formula (2) in organosilicon polymer to total peak area S of organosilicon of organosilicon polymer (mol %)=(STX1+STX2+STX3)×100/S The chemical shifts of silicon in the TX1 structure, TX2 structure, and TX3 structure are described below.

Example of TX1 structure (Ri=Rj=—$OC_2H_5$, $R^5$=—$CH_3$): −47 ppm

Example of TX2 structure (Rk=—$OC_2H_5$, $R^5$=—$CH_3$): −56 ppm

Example of TX3 structure ($R^5$=—$CH_3$): −65 ppm Measurement of average thickness Dav. of surface layer of toner particles by cross-sectional observation of toner particles with transmission electron microscope (TEM)

In an embodiment of the present invention, a cross-section of toner particles is observed by the following method.

In a specific method for observing a cross section of toner particles, the toner particles are well dispersed in a room-temperature curing epoxy resin, and the epoxy resin is cured at 40° C. for 2 days. A sample slice is cut from the cured product with a microtome having a diamond tooth. A cross section of toner particles of the sample is observed with a transmission electron microscope (TEM) (FEI electron microscope Tecnai TF20XT) at a magnification in the range of 10,000 to 100,000.

In an embodiment of the present invention, a difference in the atomic weight of atoms in the resin and organosilicon compound is utilized, and the fact that the contrast is increased with atomic weight is utilized. The contrast between materials is increased by ruthenium tetroxide staining and osmium tetroxide staining. The state of various elements in toner particles can be determined by mapping of the elements with a transmission electron microscope.

Particles to be measured have a circle-equivalent diameter Dtem within ±10% of the weight-average particle diameter of the toner particles determined by a method described below. The circle-equivalent diameter Dtem is determined from a cross section of the toner particles in a TEM photomicrograph.

Bright-field images of a cross section of toner particles are obtained with the FEI electron microscope TF20XT at an accelerating voltage of 200 kV, as described above. An EF mapping image at a Si-K edge (99 eV) is then obtained with an electron energy loss spectroscopy (EELS) detector GIF Tridiem manufactured by Gatan Inc. by a three-window method. The presence of an organosilicon polymer in the surface layer is examined in the EF mapping image. In a toner particle having a circle-equivalent diameter Dtem within ±10% of the weight-average particle diameter of the toner particles, a toner particle cross section is then evenly divided into 16 divisions around an intersection point between the long axis L of the toner particle cross section and a vertical axis L90 passing through the midpoint of the long axis L (see FIG. 1). The dividing axes extending from the intersection point to the surface layer of the toner particle are denoted by An (n is an integer in the range of 1 to 32), the length of the dividing axes is denoted by RAn, and the thickness of the toner surface layer containing the organosilicon polymer is denoted by FRAn.

The average thickness Dav. of the surface layer containing the organosilicon polymer of the toner particles is determined at 32 points on the dividing axes. The ratio of the number of dividing axes on which the thickness of the surface layer containing the organosilicon polymer of the toner particles is 5.0 nm or less to the 32 dividing axes is determined.

In an embodiment of the present invention, measurements of 10 toner particles are averaged.

[Circle-Equivalent Diameter (Dtem) Determined from Cross Section of Toner Particles in Transmission Electron Microscope (TEM) Photograph]

The circle-equivalent diameter (Dtem) is determined by the following method from a cross section of toner particles in a TEM photograph. First, the circle-equivalent diameter (Dtem) of one toner particle is calculated from a cross section of toner particles in a TEM photomicrograph using the following equation.

$$[\text{Circle-equivalent diameter } (Dtem) \text{ of one toner particle determined from cross section of toner particles in TEM photomicrograph}=(RA1+RA2+RA3+RA4+RA5+RA6+RA7+RA8+RA9+RA10+RA11+RA12+RA13+RA14+RA15+RA16+RA17+RA18+RA19+RA20+RA21+RA22+RA23+RA24+RA25+RA26+RA27+RA28+RA29+RA30+RA31+RA32)/16$$

The circle-equivalent diameter (Dtem) in a cross section of toner particles is determined by averaging the circle-equivalent diameters of 10 toner particles. [Measurement of Average Thickness (Dav.) of Surface Layer Containing Organosilicon Polymer in Toner Particles]

The average thickness (Dav.) of the surface layer containing the organosilicon polymer in the toner particles is determined by the following method.

First, the average thickness $D^{(n)}$ of the surface layer containing the organosilicon polymer in one toner particle is determined by the following method.

$$D^{(n)}=(\text{Sum of 32 thicknesses of the surface layer containing the organosilicon polymer on the dividing axes})/32$$

The thicknesses of the surface layer containing the organosilicon polymer are averaged to calculate the average thickness $D^{(n)}$ (n is an integer in the range of 1 to 10) in the 10 toner particles. The average thickness (Dav.) of the surface layer containing the organosilicon polymer in the toner particles is calculated from the average thicknesses $D^{(n)}$.

$$\text{Dav.}=\{D^{(1)}+D(2)+D(3)+D(4)+D^{(5)}+D^{(6)}+D^{(7)}+D^{(8)}+D^{(9)}+D^{(10)}\}/10$$

Concentration of Silicon Element (Atomic Percent) in Surface Layer Containing Organosilicon Polymer in Toner Particles The concentration of silicon atom [dSi] (atomic percent), the concentration of carbon atom [dC] (atomic percent), and the concentration of oxygen atom [dO] (atomic percent) in the surface layer containing the organosilicon polymer in the toner particles are determined by surface composition analysis utilizing electron spectroscopy for chemical analysis (ESCA). The following apparatus and measurement conditions are employed for ESCA.

Apparatus: Quantum 2000 manufactured by ULVAC-PHI, Inc.

ESCA measurement conditions: X-ray source Al Kα

X-rays: 100 μm 25 W 15 kV

Raster: 300 μm×200 μm

Pass Energy: 58.70 eV Step Size: 0.125 eV

Neutralization electron gun: 20 μA, 1 V Ar ion gun: 7 mA, 10 V

Number of sweeps: Si 15, C 10, O 5

In an embodiment of the present invention, the concentration of silicon atom [dSi] (atomic percent), the concentration of carbon atom [dC] (atomic percent), and the concentration of oxygen atom [dO] (atomic percent) of the surface of the toner particles are calculated from the peak intensity of each element using a relative sensitivity factor provided by PHI.

<Method for Measuring Weight-Average Molecular Weight (Mw), Number-Average Molecular Weight (Mn), and Main Peak Molecular Weight (Mp) of Toner/Toner Particles and Various Resins>

The weight-average molecular weight (Mw), number-average molecular weight (Mn), and main peak molecular weight (Mp) of toner/toner particles and various resins are measured by gel permeation chromatography (GPC) under the following conditions.

[Measurement Conditions]

Columns (manufactured by Showa Denko K.K.): Shodex GPC KF-801, KF-802, KF-803, KF-804, KF-805, KF-806, and KF-807 (diameter 8.0 mm, length 30 cm) in series Eluent: tetrahydrofuran (THF)

Temperature: 40° C.

Flow rate: 0.6 mL/min

Detector: RI

Sample concentration and amount: 10 μL of 0.1% by mass sample

[Sample Preparation]

0.04 g of a measurement object [toner/toner particles, various resins] is dispersed and dissolved in 20 mL of tetrahydrofuran, is left standing for 24 hours, and is passed through a 0.2-μm filter [Myshori Disk H-25-2 (manufactured by Tosoh Corporation)]. The filtrate is used as a sample.

A molecular weight calibration curve prepared with monodisperse polystyrene standard samples is used as a calibration curve. The standard polystyrene samples for preparing the calibration curve are TSK standard polystyrene F-850, F-450, F-288, F-128, F-80, F-40, F-20, F-10, F-4, F-2, F-1, A-5000, A-2500, A-1000, and A-500 manufactured by Tosoh Corporation. At least approximately 10 standard polystyrene samples are used.

In the preparation of GPC molecular weight distribution, measurement is started from the rising point of a chromatogram on the high molecular weight side and is continued up to a molecular weight of approximately 400 on the low-molecular-weight side.

Figure 3:
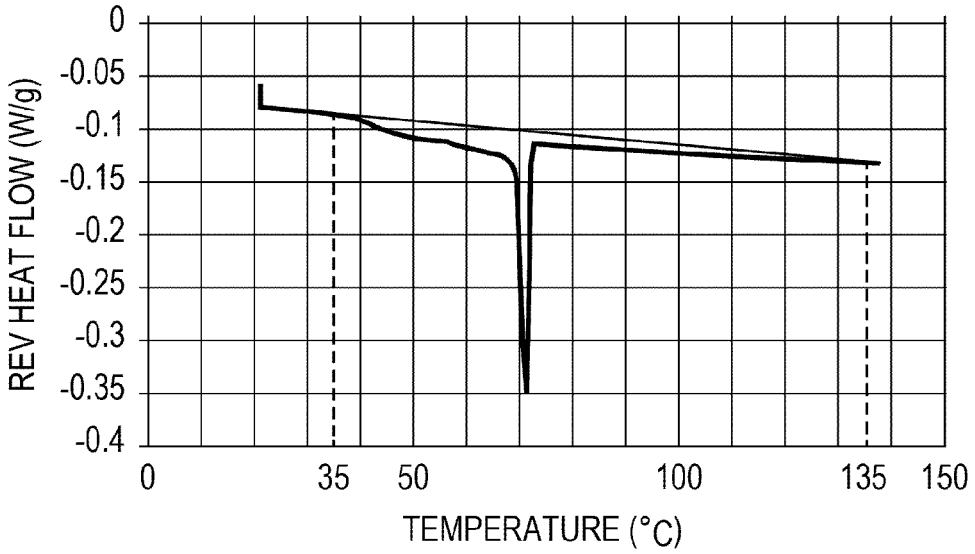
FIG. 3 is a reversing heat flow curve of a toner according to an embodiment of the present invention measured with a differential scanning calorimeter (DSC).

Measurement of Glass Transition Temperature (Tg) and Integral Heat Quantity of Toner/Toner Particles and Various Resins The glass transition temperatures (Tg) and integral heat quantity of toner/toner particles and various resins are measured with a differential scanning calorimeter (DSC) M-DSC (trade name: Q2000, manufactured by TA Instruments) according to the following procedures. 3 mg of each sample [toner (particles), various resins] is precisely weighed. The sample is placed in an aluminum pan. An empty aluminum pan is used as a reference. Measurement is performed in a measurement temperature range of 20° C. or more and 200° C. or less, at a heating rate of 1° C./min, and at normal temperature and humidity. The measurement is performed at a modulation amplitude ±0.5° C. and a frequency of 1/min. The glass transition temperature (Tg: ° C.) is calculated from the resulting reversing heat flow curve. Tg (° C.) is a central value of intersection points between the baselines before and after heat absorption and tangent lines of an endothermic curve. The integral heat quantity (J/g) of 1 g of toner (particles) given by the peak area of an endothermic main peak is determined from a DSC endothermic chart during a heating-up period. FIG. 3 shows an example of a reversing flow curve obtained from DSC measurement of toner.

The integral heat quantity (J/g) is determined from the reversing flow curve. The integral heat quantity (J/g) is calculated from a region surrounded by an endothermic curve and a straight line passing through the points of measurement at 35° C. and 135° C. with analysis software Universal Analysis 2000 for Windows (registered trademark) 2000/XP Version 4.3A (available from TA Instruments) using an Integral Peak Linear function. Measurement of Weight-Average Particle Diameter (D4) and Number-Average Particle Diameter (D1) of Toner/Toner Particles A toner/toner particles is/are subjected to measurement with a precision particle size distribution analyzer "Coulter Counter Multisizer 3" (registered trademark, manufactured by Beckman Coulter, Inc.) by an aperture impedance method and with associated dedicated software "Beckman Coulter Multisizer 3 Version 3.51" (available from Beckman Coulter, Inc.) for measurement condition setting and measured data analysis. The precision particle size distribution analyzer is equipped with a 100 μm aperture tube. The number of effective measuring channels is 25,000. The weight-average particle diameter (D4) and the number-average particle diameter (D1) of the toner/toner particles are calculated by analyzing the measured data.

An aqueous electrolyte used in the measurement may be approximately 1% by mass special grade sodium chloride dissolved in ion-exchanged water, for example, "ISOTON II" (manufactured by Beckman Coulter, Inc.).

Before the measurement and analysis, the dedicated software is set up as described below.

On the "Standard operation mode (SOM) setting screen" of the dedicated software, the total count number in control mode is set at 50,000 particles, the number of measurements is set at 1, and the Kd value is set at a value obtained with "standard particles 10.0 μm" (manufactured by Beckman Coulter, Inc.). A threshold/noise level measurement button is pushed to automatically set the threshold and noise level. The current is set at 1600 μA. The gain is set at 2. Isoton II is chosen as an electrolyte solution. Flushing of aperture tube after measurement is checked.

On the "Conversion of pulse into particle diameter setting screen" of the dedicated software, the bin interval is set at logarithmic particle diameter, the particle diameter bin is set at 256 particle diameter bins, and the particle diameter range is set at 2 μm or more and 60 μm or less.

The specific measurement method is as follows:

(1) A 250-mL round-bottom glass beaker for Multisizer 3 is charged with approximately 200 mL of the aqueous electrolyte and is placed on a sample stand. A stirrer rod is rotated counterclockwise at 24 revolutions per second. Soiling and air bubbles in the aperture tube are removed using the "Aperture flushing" function of the analysis software.

(2) A 100-mL flat-bottom glass beaker is charged with approximately 30 mL of the aqueous electrolyte. To the aqueous electrolyte is added approximately 0.3 mL of a dispersant "Contaminon N" (a 10% by mass aqueous neutral detergent for cleaning precision measuring instruments composed of a nonionic surfactant, an anionic surfactant, and an organic builder, pH 7, manufactured by Wako Pure Chemical Industries, Ltd.) diluted 3-fold by mass with ion-exchanged water.

(3) A predetermined amount of ion-exchanged water is poured into a water tank of an ultrasonic disperser "Ultrasonic Dispersion System Tetora 150" (manufactured by Nikkaki-Bios Co., Ltd.). The ultrasonic disperser includes two oscillators having an oscillation frequency of 50 kHz and has an electrical output of 120 W. The two oscillators have a phase difference of 180 degrees. Approximately 2 mL of Contaminon N is added to the ion-exchanged water.

(4) The beaker prepared in (2) is placed in a beaker-holding hole in the ultrasonic disperser, and the ultrasonic disperser is actuated. The vertical position of the beaker is adjusted such that the surface resonance of the aqueous electrolyte in the beaker is highest.

(5) While the aqueous electrolyte in the beaker prepared in (4) is exposed to ultrasonic waves, approximately 10 mg of toner (particles) is added little by little to the aqueous electrolyte and is dispersed. The ultrasonic dispersion treatment is continued for another 60 seconds. During the ultrasonic dispersion, the water temperature of the water tank is controlled at a temperature of 10° C. or more and 40° C. or less.

(6) The aqueous electrolyte containing dispersed toner (particles) produced in (5) is added dropwise using a pipette into the round-bottom beaker prepared in (1) placed on the sample stand such that the measurement concentration is approximately 5%. Measurement is continued until the number of measured particles reaches 50,000.

(7) The measured data are analyzed by using the accessory dedicated software to determine the weight-average particle diameter (D4). The weight-average particle diameter (D4) is the "average diameter" on the analysis/volume statistics (arithmetic mean) screen in the setting of graph/% by volume in the dedicated software. The number-average particle diameter (D1) is the "Average diameter" on the "Analysis/number statistics (arithmetic mean)" screen in the setting of graph/% by number in the dedicated software.

Method for Measuring Average Circularity of Toner/Toner Particles

The average circularity of toner/toner particles is measured with a flow particle image analyzer "FPIA-3000" (manufactured by SYSMEX Corporation) under the measurement and analysis conditions for calibration.

A proper amount of a surfactant alkylbenzenesulfonate is added as a dispersant to 20 mL of ion-exchanged water. 0.02 g of a sample is then added to the ion-exchanged water. The sample is dispersed for 2 minutes with a table-top ultrasonic cleaner dispersing apparatus having an oscillation frequency of 50 kHz and an electrical output of 150 W ("VS-150" manufactured by VELVO-CLEAR), thereby producing a dispersion liquid for measurement. During the dispersion, the dispersion liquid is cooled to a temperature of 10° C. or more and 40° C. or less.

The flow particle image analyzer equipped with a standard objective lens (magnification: 10) is used in the measurement. The sheath liquid is a particle sheath "PSE-900A" (SYSMEX Corporation). The dispersion liquid produced through the procedures described above is introduced into the flow particle image analyzer. 3000 toner (particles) are measured in an HPF measurement mode and a total count mode. The binarization threshold in particle analysis is 85%. The analysis particle diameter is limited to a circle-equivalent diameter of 1.98 μm or more and 19.92 μm or less. The average circularity of the toner/toner particles is determined.

Before measurement, automatic focusing is adjusted with standard latex particles (for example, 5100A manufactured by Duke Scientific diluted with ion-exchanged water). Focusing can be adjusted every 2 hours after the start of measurement.

In the circularity distribution of toner/toner particles, a mode circularity of 0.98 or more and 1.00 or less means that most of the toner/toner particles is close to spherical. This results in a significant decrease in adhesion strength of toner/toner particles to a photosensitive member due to image force and van der Waals force and a marked increase in transfer efficiency.

With respect to mode circularity, a circularity of 0.40 to 1.00 is divided into 61 divisions in increments of 0.01, that is, 0.40 or more and less than 0.41, 0.41 or more and less than 0.42, . . . , 0.99 or more and less than 1.00, and 1.00. The circularity of each measured particle is assigned to the corresponding division. The mode circularity refers to the circularity of a division having the highest frequency in the circularity frequency distribution.

EXEMPLARY EMBODIMENTS

The present invention will be further described below with exemplary embodiments. However, the present invention is not limited to the exemplary embodiments. Unless otherwise specified, "parts" refers to "parts by mass". A production example of a charge control resin for use in the present invention will be described below.

Production Example of Charge Control Resin 1

A reaction vessel equipped with a reflux tube, an agitator, a thermometer, a nitrogen inlet, a dropping apparatus, and a decompressor was charged with 250 parts by mass of methanol, 150 parts by mass of 2-butanone, and 100 parts by mass of 2-propanol as solvents, and 88 parts by mass of styrene, 6.0 parts by mass of 2-ethylhexyl acrylate, and 5.0 parts by mass of 2-acrylamide-2-methylpropanesulfonic acid as monomers. The monomer solution was heated under reflux at normal pressure while stirring. 1.0 part by mass of a polymerization initiator 2,2'-azobisisobutyronitrile diluted with 20 parts by mass of 2-butanone was added dropwise to the monomer solution for 30 minutes. The solution was stirred for 5 hours. 1.0 part by mass of 2,2'-azobisisobutyronitrile diluted with 20 parts by mass of 2-butanone was added dropwise to the solution for 30 minutes. The solution was stirred under reflux at normal pressure for 5 hours, thereby completing polymerization.

After the polymerization solvent was evaporated under reduced pressure, the resulting polymer was roughly crushed to 100 μm or less with a cutter mill having a 150-mesh screen and was pulverized with a jet mill. The fine particles were classified through a 250-mesh sieve, and particles having a diameter of 60 μm or less were collected. The particles were then dissolved in methyl ethyl ketone such that the concentration of the particles was 10%. The resulting solution was slowly poured into methanol for reprecipitation. The amount of the methanol was 20 times the amount of the methyl ethyl ketone. The resulting precipitate was washed with methanol, was filtered, and was dried under vacuum at 35° C. for 48 hours. The amount of methanol for washing was one-half the amount of methanol for reprecipitation.

The vacuum-dried particles were redissolved in methyl ethyl ketone such that the concentration of the particles was 10%. The resulting solution was slowly poured into n-hexane for reprecipitation. The amount of the n-hexane was 20 times the amount of the methyl ethyl ketone. The resulting precipitate was washed with n-hexane, was filtered, and was dried under vacuum at 35° C. for 48 hours. The amount of n-hexane for washing was one-half the amount of n-hexane for reprecipitation. The charge control resin thus produced had a Tg of approximately 82° C., a main peak molecular weight (Mp) of 21,300, a number-average molecular weight (Mn) of 12,400, a weight-average molecular weight (Mw) of 20,900, and an acid value of 15.9 mgKOH/g. The resin is hereinafter referred to as a charge control resin 1.

Production Example of Polyester Resin (1)

Terephthalic acid: 11.4 mol

Propylene oxide adduct of bisphenol A (PO-BPA, propylene oxide/bisphenol A=2/1 (mol/mol)): 11.0 mol An autoclave was charged with these monomers and an esterification catalyst and was equipped with a decompressor, a water separator, a nitrogen gas induction apparatus, a temperature measuring apparatus, and an agitator. The monomers were allowed to react in a nitrogen atmosphere under reduced pressure at 205° C. in accordance with a common procedure such that the resulting polyester resin (1) had a Tg of 64° C. The polyester resin (1) had a weight-average molecular weight (Mw) of 8,200 and a number-average molecular weight (Mn) of 3,280.

Production Example of Polyester Resin (2)

Synthesis of Prepolymer Having Isocyanate Group

Ethylene oxide adduct of bisphenol A (ethylene oxide/bisphenol A=2/1 (mol/mol)): 730 parts by mass Phthalic acid: 300 parts by mass Dibutyltin oxide: 3.0 parts by mass These monomers were allowed to react at 220° C. for 7 hours while stirring, were allowed to react under reduced pressure for 5 hours, were cooled to 80° C., and were allowed to react with 190 parts by mass of isophorone diisocyanate in ethyl acetate for 2 hours, thus producing a polyester resin having an isocyanate group. 25 parts by mass of the polyester resin having an isocyanate group was allowed to react with 1 part by mass of isophoronediamine at 50° C. for 2 hours, thus producing a polyester resin (2) composed mainly of a polyester having a urea group. The polyester resin (2) had a weight-average molecular weight (Mw) of 23,500, a number-average molecular weight (Mn) of 3,120, and a peak molecular weight of 7,400.

Exemplary Embodiment 1

A four-neck container equipped with a reflux tube, an agitator, a thermometer, and a nitrogen inlet was charged with 700 parts by mass of ion-exchanged water, 1000 parts by mass of 0.1 mol/L aqueous $Na_3PO_4$, and 24.0 parts by mass of 1.0 mol/L aqueous HCl, and was held at 60° C. while stirring with a high-speed agitator TK-homo mixer at 12,000 rpm. 85 parts by mass of 1.0 mol/L aqueous $CaCl_2$ was slowly added to the resulting mixture to produce an aqueous dispersion medium containing a fine poorly water-soluble dispersion stabilizer $Ca_3(PO_4)_2$.

Styrene: 70.0 parts by mass n-Butyl acrylate: 30.0 parts by mass

Divinylbenzene: 0.02 parts by mass

Copper phthalocyanine pigment (Pigment Blue 15:3) (P.B. 15:3): 6.5 parts by mass Polyester resin (1): 5.0 parts by mass Charge control agent 1 (3,5-di-tert-butylsalicylic acid aluminum compound): 0.3 parts by mass Charge control resin 1: 0.3 parts by mass Release agent (behenyl behenate, melting point: 72.1° C.): 12.5 parts by mass These materials were dispersed in an attritor for 3 hours to produce a polymerizable monomer composition 1. The polymerizable monomer composition 1 was held at 60° C. for 20 minutes. 14.0 parts by mass of a polymerization initiator t-butyl peroxypivalate (45% solution in toluene) was added to the polymerizable monomer composition 1. The polymerizable monomer composition 1 was then poured into the aqueous medium. While the rotational speed of the high-speed agitator was maintained at 12,000 rpm, particles of the polymerizable monomer composition 1 were formed (granulated) for 10 minutes. The high-speed agitator was then replaced with a propeller agitator. The temperature of the aqueous dispersion medium was increased to 70° C. The particles of the polymerizable monomer composition 1 were allowed to react for 5 hours while stirring slowly (hereinafter referred to as a reaction 1 process). At this time, the aqueous medium had a pH of 5.1. The polymerization conversion was 50% or more at this stage. Particles to become base particles were observed in the aqueous medium. 7.5 parts by mass of methyltriethoxysilane was added to the aqueous medium. The pH was adjusted to be 7.0 by the addition of 8.0 parts by mass of 1.0 mol/L aqueous NaOH. The temperature of the aqueous dispersion medium in the container was increased to 85° C. and was maintained for 5 hours (hereinafter referred to as a reaction 2 process). 300 parts by mass of ion-exchanged water was then added to the aqueous medium. The reflux tube was removed from the container, and a distillation apparatus was attached to the container. The aqueous dispersion medium in the container was allowed to react at 100° C. for 5 hours to produce a polymer slurry 1 (hereinafter referred to as a reaction 3 process). The distillate fraction was 300 parts by mass. After cooling to 30° C., diluted hydrochloric acid was added to the container containing the polymer slurry 1 to remove the dispersion stabilizer. The polymer slurry was then filtered, washed, and dried to produce toner particles having a weight-average particle diameter of 5.6 μm. The toner particles are hereinafter referred to as toner particles 1. Table 1 lists the formula and conditions for the toner particles 1. Table 5 lists the physical properties of the toner particles 1. Silicon mapping in TEM observation of the toner particles 1 showed that silicon atoms were uniformly present on the surface, and the covering layer was not formed by sticking of particles. Likewise, the surface layer containing the organosilicon polymer was also examined by silicon mapping in the following exemplary embodiments and comparative examples.

It was also confirmed in other exemplary embodiments described below that particles to become base particles were observed in the aqueous medium at the point in time when the organosilicon compound was added.

Exemplary Embodiments 2 to 9, 11, 12, 18 to 21, and 26 to 29

Toner particles 2 to 9, 11, 12, 18 to 21, and 26 to 29 were produced in the same manner as in Exemplary Embodiment 1 except that the production conditions and formulae were changed as listed in Tables 1 to 3 and 5. Table 1 lists the formulae and conditions for the toner particles, and Table 5 lists the physical properties of the toner particles. Silicon mapping in TEM observation of the toner particles 2 to 9, 11, 12, 18 to 21, and 26 to 29 showed that silicon atoms were uniformly present in the surface layer, and the covering layer was not formed by sticking of particles.

Exemplary Embodiment 10

Toner particles 10 were produced in the same manner as in Exemplary Embodiment 1, except that 7.5 parts by mass of methyltriethoxysilane was replaced with 7.5 parts by mass of methyldiethoxychlorosilane, and the pH was adjusted to be 5.1 with 0.8 parts by mass of 1.0 mol/L aqueous NaOH. Table 1 lists the formula and conditions for the toner particles 10. Table 5 lists the physical properties of the toner particles 10. Silicon mapping in TEM observation of the toner particles 10 showed that silicon atoms were uniformly present in the surface layer, and the covering layer was not formed by sticking of particles.

Exemplary Embodiment 13

Toner particles 13 were produced in the same manner as in Exemplary Embodiment 1 except that the pH of the aqueous medium was changed to 3.8 by the addition of 2.0 parts by mass of 1.0 mol/L aqueous HCl instead of 1.0 mol/L aqueous NaOH. Table 2 lists the formula and conditions for the toner particles 13. Table 5 lists the physical properties of the toner particles 13. Silicon mapping in TEM observation of the toner particles 13 showed that silicon atoms were uniformly present in the surface layer, and the covering layer was not formed by sticking of particles.

Exemplary Embodiment 14

Toner particles 14 were produced in the same manner as in Exemplary Embodiment 1, except that the pH of the aqueous medium was changed to 4.2 by the addition of 1.5 parts by mass of 1.0 mol/L aqueous HCl instead of 1.0 mol/L aqueous NaOH, and the reaction 3 process was also performed at a pH of 4.2. Table 2 lists the formula and conditions for the toner particles 14. Table 5 lists the physical properties of the toner particles 14. Silicon mapping in TEM observation of the toner particles 14 showed that silicon atoms were uniformly present in the surface layer, and the covering layer was not formed by sticking of particles.

Exemplary Embodiment 15

Toner particles 15 were produced in the same manner as in Exemplary Embodiment 1, except that the amount of 1.0 mol/L aqueous NaOH was changed to 14.0 parts by mass to change the pH of the aqueous medium to 8.9, and the reaction 3 process was also performed at a pH of 8.9. Table 2 lists the formula and conditions for the toner particles 15. Table 5 lists the physical properties of the toner particles 15. Silicon mapping in TEM observation of the toner particles 15 showed that silicon atoms were uniformly present in the surface layer, and the covering layer was not formed by sticking of particles.

Exemplary Embodiment 16

Toner particles 16 were produced in the same manner as in Exemplary Embodiment 1, except that the amount of 1.0 mol/L aqueous NaOH was changed to 17.0 parts by mass to change the pH of the aqueous medium to 10.0, and the reaction 3 process was also performed at a pH of 10.0. Table 2 lists the formula and conditions for the toner particles 16. Table 5 lists the physical properties of the toner particles 16. Silicon mapping in TEM observation of the toner particles 16 showed that silicon atoms were uniformly present in the surface layer, and the covering layer was not formed by sticking of particles.

Exemplary Embodiment 17

Toner particles 17 were produced in the same manner as in Exemplary Embodiment 1, except that the amount of 1.0 mol/L aqueous NaOH was changed to 18.5 parts by mass to change the pH of the aqueous medium to 10.4, and the reaction 3 process was performed at a pH of 10.4. Table 2 lists the formula and conditions for the toner particles 17. Table 5 lists the physical properties of the toner particles 17. Silicon mapping in TEM observation of the toner particles 17 showed that silicon atoms were uniformly present in the surface layer, and the covering layer was not formed by sticking of particles.

Exemplary Embodiment 22

Unlike Exemplary Embodiment 1, an autoclave equipped with a reflux tube, an agitator, a thermometer, a safety valve, a valve, and a dropping apparatus was used, and the reaction 3 process conditions were changed as described below.

The temperature was increased to 104° C. by pressurization, and the reaction was performed while volatile components having a boiling point of less than 100° C. at normal pressure were evaporated through the valve. Except for these, toner particles 22 were produced in the same manner as in Exemplary Embodiment 1. Table 3 lists the formula and conditions for the toner particles 22. Table 5 lists the physical properties of the toner particles 22. Silicon mapping in TEM observation of the toner particles 22 showed that silicon atoms were uniformly present in the surface layer, and the covering layer was not formed by sticking of particles.

Exemplary Embodiment 23

The procedure described in Exemplary Embodiment 1 was conducted until the end of the reaction 1 process. After the reaction 1 process, the aqueous medium in which resin particles were dispersed was poured into the container containing 7.5 parts by mass of methyltriethoxysilane. The pH of the aqueous medium was adjusted to be 7.0 by the addition of 8.0 parts by mass of 1.0 mol/L aqueous NaOH. The temperature of the aqueous dispersion medium in the container was increased to 85° C. and was maintained for 5 hours (hereinafter referred to as a reaction 2 process). After that, toner particles 23 were produced in the same manner as in Exemplary Embodiment 1. Table 3 lists the formula and conditions for the toner particles 23. Tables 3 and 5 list the physical properties of the toner particles 23. Silicon mapping in TEM observation of the toner particles 23 showed that silicon atoms were uniformly present in the surface layer, and the covering layer was not formed by sticking of particles.

Exemplary Embodiment 24

Polyester resin (1): 65.0 parts by mass

Polyester resin (2): 35.0 parts by mass

Copper phthalocyanine pigment (Pigment Blue 15:3): 6.5 parts by mass

Charge control agent 1 (3,5-di-tert-butylsalicylic acid aluminum compound): 0.4 parts by mass Charge control resin 1: 0.4 parts by mass Release agent (behenyl behenate, melting point: 72.1° C.): 12.5 parts by mass These materials were dissolved in 400 parts by mass of toluene to produce a solution.

A four-neck container equipped with a Liebig reflux tube was charged with 700 parts by mass of ion-exchanged water, 1000 parts by mass of 0.1 mol/L aqueous $Na_3PO_4$, and 24.0 parts by mass of 1.0 mol/L aqueous HCl, and was held at 60° C. while stirring with a high-speed agitator TK-homo mixer at 12,000 rpm. 85 parts by mass of 1.0 mol/L aqueous $CaCl_2$ was slowly added to the resulting mixture to produce an aqueous dispersion medium containing a fine poorly water-soluble dispersion stabilizer $Ca_3(PO_4)_2$.

100 parts by mass of the solution was then added to the aqueous dispersion medium while stirring with a TK-homo mixer at 12,000 rpm, and was stirred for 5 minutes. The liquid mixture was then held at 70° C. for 5 hours. The liquid mixture had a pH of 5.1. 7.5 parts by mass of methyltriethoxysilane was then added to the liquid mixture. The pH was adusted to be 7.0 by the addition of 8.0 parts by mass of 1.0 mol/L aqueous NaOH. The liquid mixture of the aqueous dispersion medium and the solution was heated to 85° C. and was held for 5 hours. 300 parts by mass of ion-exchanged water was added to the liquid mixture. The reflux tube was removed from the container, and a distillation apparatus was attached to the container. The liquid mixture was allowed to react at 100° C. for 5 hours to produce a polymer slurry 24. The distillate fraction was 320 parts by mass. Diluted hydrochloric acid was added to the container containing the polymer slurry 24 to remove the dispersion stabilizer. The polymer slurry 24 was then filtered, washed, and dried to produce toner particles having a weight-average particle diameter of 5.6 μm. The toner particles are hereinafter referred to as toner particles 24. Table 3 lists the formula and conditions for the toner particles 24. Table 5 lists the physical properties of the toner particles 24. Silicon mapping in TEM observation of the toner particles 24 showed that silicon atoms were uniformly present in the surface layer, and the covering layer was not formed by sticking of particles.

Exemplary Embodiment 25 Synthesis of Amorphous Polyester Resin (1)

Ethylene oxide adduct of bisphenol A (ethylene oxide/bisphenol A=2/1 (mol/mol)): 10 molar parts Propylene oxide adduct of bisphenol A (propylene oxide/bisphenol A=2/1 (mol/mol)): 95 molar parts Terephthalic acid: 50 molar parts Fumaric acid: 30 molar parts Dodecenylsuccinic acid: 25 molar parts A flask equipped with an agitator, a nitrogen inlet, a temperature sensor, and a rectifying column was charged with these monomers and was heated to 200° C. for 1 hour. It was confirmed that the reaction system was uniformly stirred. Tin distearate was added to the monomers. The amount of the tin distearate was 1.0% by mass of the total mass of the monomers. The monomers were heated from 200° C. to 250° C. for 5 hours while produced water was distilled off, and a dehydration condensation reaction was performed at 250° C. for another 2 hours. As a result, an amorphous polyester resin (1) was produced. The amorphous polyester resin (1) had a glass transition temperature of 59.4° C., an acid value of 14.7 mgKOH/g, a hydroxyl value of 29.2 mgKOH/g, a weight-average molecular weight of 13,200, a number-average molecular weight of 4,000, and a softening point of 108° C.

Synthesis of Amorphous Polyester Resin (2)

Ethylene oxide adduct of bisphenol A (ethylene oxide/bisphenol A=2/1 (mol/mol)): 49 molar parts Propylene oxide adduct of bisphenol A (propylene oxide/bisphenol A=2/1 (mol/mol)): 49 molar parts Terephthalic acid: 65 molar parts Dodecenylsuccinic acid: 30 molar parts A flask equipped with an agitator, a nitrogen inlet, a temperature sensor, and a rectifying column was charged with these monomers and was heated to 200° C. for 1 hour. It was confirmed that the reaction system was uniformly stirred. Tin distearate was added to the monomers. The amount of the tin distearate was 0.8% by mass of the total mass of the monomers. The reaction system was heated from 200° C. to 240° C. for 5 hours while produced water was distilled off, and a dehydration condensation reaction was performed at 240° C. for another 2 hours. The reaction system was then cooled to 190° C. 5 molar parts of trimellitic anhydride was slowly added to the reaction system, and the reaction was continued at 190° C. for 1 hour. As a result, an amorphous polyester resin (2) was produced. The amorphous polyester resin (2) had a glass transition temperature of 54.1° C., an acid value of 15.1 mgKOH/g, a hydroxyl value of 23.1 mgKOH/g, a weight-average molecular weight of 51,200, a number-average molecular weight of 5,100, and a softening point of 104° C.

Preparation of Resin Particle Dispersion Liquid (1)

Amorphous polyester resin (1): 100 parts by mass

Methyl ethyl ketone: 50 parts by mass

Isopropyl alcohol: 20 parts by mass

A container was charged with the methyl ethyl ketone and isopropyl alcohol. The resin was then slowly charged into the container and was completely dissolved while stirring. Thus, an amorphous polyester resin (1) solution was produced. While the container containing the amorphous polyester solution was maintained at 65° C., 5 parts by mass of 10% aqueous ammonia was slowly added dropwise to the amorphous polyester solution while stirring, and 230 parts by mass of ion-exchanged water was slowly added dropwise to the amorphous polyester solution at 10 mL/min, thereby causing phase inversion emulsification. The solvent was removed with an evaporator under reduced pressure to produce a resin particle dispersion liquid (1) of the amorphous polyester resin (1). The resin particles had a volume-average particle diameter of 130 nm. The resin particle solid content was adjusted with ion-exchanged water to be 20%.

Preparation of Resin Particle Dispersion Liquid (2)

Amorphous polyester resin (2): 100 parts by mass

Methyl ethyl ketone: 50 parts by mass

Isopropyl alcohol: 20 parts by mass

A container was charged with the methyl ethyl ketone and isopropyl alcohol. The amorphous polyester resin (2) was then slowly charged into the container and was completely dissolved while stirring. Thus, an amorphous polyester resin (2) solution was produced. While the amorphous polyester resin (2) solution was maintained at 40° C., 3.5 parts by mass of 10% aqueous ammonia was slowly added dropwise to the polyester resin (2) solution while stirring, and 230 parts by mass of ion-exchanged water was slowly added dropwise to the amorphous polyester resin (2) solution at 10 mL/min, thereby causing phase inversion emulsification. The solvent was removed under reduced pressure to produce a resin particle dispersion liquid (2) of the amorphous polyester resin (2). The resin particles had a volume-average particle diameter of 150 nm. The resin particle solid content was adjusted with ion-exchanged water to be 20%.

Preparation of Colorant Particle Dispersion Liquid 1

Copper phthalocyanine (Pigment Blue 15:3): 45 parts by mass

Ionic surfactant Neogen RK (manufactured by Dai-ichi Kogyo Seiyaku Co., Ltd.): 5 parts by mass Ion-exchanged water: 190 parts by mass These components were dispersed with a homogenizer (IKA Ultra-Turrax) for 10 minutes. Dispersion treatment was performed with Ultimizer (a counter collision type wet mill: manufactured by Sugino Machine Ltd.) at a pressure of 250 MPa for 20 minutes. A colorant particle dispersion liquid 1 was thus produced. The colorant particles had a volume-average particle diameter of 115 nm. The solid content of the colorant particle dispersion liquid 1 was 20%.

Preparation of Release Agent Particle Dispersion Liquid

Olefin wax (melting point: 84° C.): 60 parts by mass

Ionic surfactant Neogen RK (manufactured by Dai-ichi Kogyo Seiyaku Co., Ltd.): 2.0 parts by mass Ion-exchanged water: 250 parts by mass These materials were well-dispersed at 100° C. with IKA Ultra-Turrax T50 and were dispersed at 115° C. for 1 hour with a pressure ejection type Gaulin homogenizer. The resulting release agent particle dispersion liquid had a volume-average particle diameter of 155 nm and a solid content of 20%.

Resin particle dispersion liquid (1): 400 parts by mass

Resin particle dispersion liquid (2): 300 parts by mass

Colorant particle dispersion liquid 1: 50 parts by mass

Release agent particle dispersion liquid: 50 parts by mass

After a stainless steel flask was charged with 2.2 parts by mass of an ionic surfactant Neogen RK, the materials described above were stirred. After the pH of the mixture was adjusted to be 3.7 by dropwise addition of 1 mol/L aqueous nitric acid, 0.35 parts by mass of polyaluminum sulfate was dispersed in the mixture with IKA Ultra-Turrax. While the mixture was stirred in the stainless steel flask in a heating oil bath, the aqueous medium was heated to 50° C. The mixture was held at 50° C. for 40 minutes. After the pH of the system was adjusted to be 7.0 by the addition of 1 mol/L aqueous sodium hydroxide, the stainless steel flask was closed, and the aqueous medium was slowly heated to 85° C. while stirring and was held at 85° C. for 5 hours. 12.0 parts by mass of methyltriethoxysilane was gently added to the system. The aqueous medium was held at 95° C. for 7.5 hours. After that, 2.0 parts by mass of an ionic surfactant Neogen RK was charged into the stainless steel flask, and the reaction was performed at 100° C. for 5 hours. After the completion of the reaction, 300 parts by mass of distillate fraction was collected by distillation under reduced pressure at 85° C. The distillate fraction was then cooled, filtered, and dried. The product was redispersed in 5 L of ion-exchanged water at 40° C., was stirred with a stirring blade (300 rpm) for 15 minutes, and was filtered.

The redispersion, filtration, and washing were repeatedly performed until the filtrate had an electrical conductivity of 6.0 μS/cm or less. Thus, toner particles 25 were produced. Table 3 lists the formula and conditions for the toner particles 25. Table 5 lists the physical properties of the toner particles 25. Silicon mapping in TEM observation of the toner particles 25 showed that silicon atoms were uniformly present in the surface layer.

Comparative Example 1

A four-neck container equipped with a reflux tube, an agitator, a thermometer, and a nitrogen inlet was charged with 700 parts by mass of ion-exchanged water, 1000 parts by mass of 0.1 mol/L aqueous $Na_3PO_4$, and 24.0 parts by mass of 1.0 mol/L aqueous HCl. The mixture was stirred with a high-speed agitator TK-homo mixer at 12,000 rpm at a water temperature of 60° C. 85 parts by mass of 1.0 mol/L aqueous $CaCl_2$ was slowly added to the resulting mixture to produce an aqueous dispersion medium containing a fine poorly water-soluble dispersion stabilizer $Ca_3(PO_4)_2$.

Styrene: 70.0 parts by mass n-Butyl acrylate: 30.0 parts by mass

Divinylbenzene: 0.02 parts by mass

Methyltriethoxysilane 1.5 parts by mass

Copper phthalocyanine pigment (Pigment Blue 15:3) (P.B. 15:3): 6.5 parts by mass Polyester resin (1): 5.0 parts by mass Charge control agent 1 (3,5-di-tert-butylsalicylic acid aluminum compound): 0.3 parts by mass Charge control resin 1: 0.3 parts by mass Release agent (behenyl behenate, melting point: 72.1° C.): 12.5 parts by mass These materials were dispersed in an attritor for 3 hours to produce a polymerizable monomer composition 1. The polymerizable monomer composition 1 was held at 60° C. for 20 minutes. The polymerizable monomer composition 1 to which 14.0 parts by mass of a polymerization initiator t-butyl peroxypivalate (45% solution in toluene) was added was then poured into the aqueous medium. While the rotational speed of the high-speed agitator was maintained at 12,000 rpm, particles of the polymerizable monomer composition 1 were formed (granulated) for 10 minutes. The high-speed agitator was then replaced with a propeller agitator. The aqueous dispersion medium was cooled to 30° C. and was allowed to react for 5 hours while stirring slowly (reaction 1 process). At this time, the aqueous medium had a pH of 5.1. The aqueous dispersion medium was held for another 5 hours (reaction 2 process) to produce a comparative polymer slurry 1. Diluted hydrochloric acid was added to the container containing the comparative polymer slurry 1 to remove the dispersion stabilizer. The comparative polymer slurry 1 was then filtered, washed, and dried to produce toner particles having a weight-average particle diameter of 5.7 μm. The toner particles are hereinafter referred to as comparative toner particles 1. Table 4 lists the formula and conditions for the comparative toner particles 1. Table 6 lists the physical properties of the comparative toner particles 1. Silicon mapping in TEM observation of the comparative toner particles 1 showed that silicon atoms were nonuniformly present on the surface.

Comparative Examples 2 to 9

Comparative toner particles 2 to 9 were produced in the same manner as in Comparative Example 1 except that the production conditions and formulae were changed as listed in Table 4. Table 4 lists the formulae and conditions for the comparative toner particles, and Table 6 lists the physical properties of the comparative toner particles.

Silicon mapping in TEM observation of the comparative toner particles 2 showed that silicon atoms were nonuniformly present in the surface layer.

Silicon mapping in TEM observation of the comparative toner particles 3 to 9 showed that a small number of silicon atoms were present in the surface layer.

Comparative Example 10

900 parts by mass of ion-exchanged water and 95 parts by mass of poly(vinyl alcohol) in a four-neck flask equipped with a high-speed agitator TK-homo mixer were heated to 55° C. while stirring at a rotational speed of 1400 rpm, thereby producing an aqueous dispersion medium. Composition of Monomer Dispersion Liquid Styrene: 70.0 parts by mass n-Butyl acrylate: 30.0 parts by mass Carbon black: 10.0 parts by mass Release agent (behenyl behenate, melting point: 72.1° C.): 12.5 parts by mass These materials were dispersed in an attritor for 3 hours. 14.0 parts by mass of a polymerization initiator t-butyl peroxypivalate was added to the materials to produce a monomer dispersion liquid.

The monomer dispersion liquid was added to the dispersion medium in the four-neck flask. The rotational speed was maintained for 10 minutes to form particles of the monomer dispersion liquid (granulation). Polymerization was then performed at 55° C. for 1 hour, at 65° C. for 4 hours, and at 80° C. for 5 hours while stirring at 50 rpm. After the completion of the polymerization, the slurry was cooled and was washed with purified water multiple times to remove the dispersant. The slurry was washed and dried to produce black toner particles as a base material. The black toner particles had a weight average particle size of 5.5 μm.

3 parts by mass of 0.3% by mass sodium dodecylbenzenesulfonate solution was added to a mixture solution of 2 parts by mass of isoamyl acetate and silicon compounds: 4.0 parts by mass of tetraethoxysilane and 0.5 parts by mass of methyltriethoxysilane. The mixture was stirred with an ultrasonic homogenizer to produce a silane mixed solution A of isoamyl acetate, tetraethoxysilane, and methyltriethoxysilane.

1.0 part by mass of the base material black toner particles were added to 30 parts by mass of 0.3% by mass aqueous sodium dodecylbenzenesulfonate to produce a black toner particle dispersion liquid A. The silane mixed solution A and then 5 parts by mass of 30% by mass aqueous $NH_4OH$ were added to the black toner particle dispersion liquid A and were allowed to react at room temperature (25° C.) for 24 hours while stirring. The product was washed with ethanol and then with purified water. Particles were filtered off and were dried to produce comparative toner particles 10. The comparative toner particles 10 had a weight average particle size of 5.6 μm. Silicon mapping in TEM observation of the comparative toner particles 10 showed that a small number of silicon atoms were present in a covering layer formed by sticking of agglomerates.

Production Example of Toner 1

100 parts by mass of the toner particles 1 were mixed with 0.5 parts by mass of hydrophobic silica having a BET specific surface area of 180 $m^2/g$ subjected to hydrophobic treatment with 3.0% by mass of hexamethyldisilazane and 2% by mass of 100 cps silicone oil and 0.1 parts by mass of aluminum oxide having a BET specific surface area of 50 $m^2/g$ in a Henschel mixer (manufactured by Mitsui Mining Co., Ltd.), thereby producing a toner 1.

Production Examples of Toners 2 to 29

Toners 2 to 29 were produced in the same manner as in the production example of the toner 1 except that the toner particles 1 were replaced with the toner particles 2 to 29.

Production Examples of Comparative Toners 1 to 10

Comparative toners 1 to 10 were produced in the same manner as in the production example of the toner 1 except that the toner particles 1 were replaced with the comparative toner particles 1 to 10.

Evaluation

The toners were evaluated as described below. Tables 7 to 10 show the evaluation results.

Evaluation of Environmental Stability and Development Endurance

Figure 4:
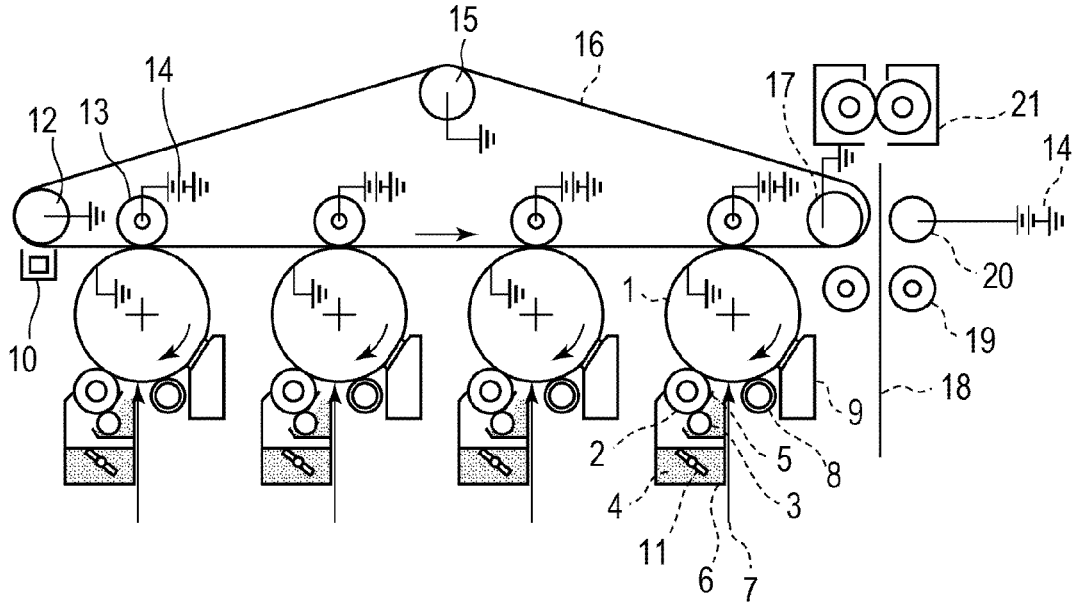
FIG. 4 is a schematic view of an image-forming apparatus used in an embodiment of the present invention.

A toner cartridge of a tandem system laser-beam printer LBP9600C manufactured by CANON KABUSHIKI KAISHA as illustrated in FIG. 4 was charged with 200 g of toner. The toner cartridge was left to stand in a low temperature and low humidity L/L (temperature 10° C./humidity 15% RH) environment, in a normal temperature and humidity N/N (25° C./50% RH) environment, or in a high temperature and high humidity H/H (32.5° C./85% RH) environment for 24 hours. After the toner cartridge was left to stand in each environment for 24 hours, the color toner cartridge was mounted in LBP9600C. An image including a solid image portion and having a printing rate of 5.0% was printed on 5,000 A4 sheets (70 $g/m^2$) in the transverse direction. The initial image and the image on the 5,000th sheet were evaluated for the solid image density (toner bearing amount: 0.40 $mg/cm^{2)}$ and fogging. Soiling of components (filming, development stripes, melt-adhesion to drum) after 5,000 sheets output was also evaluated.

The toner cartridge of LBP9600C loaded with toner was left to stand in a severe environment (40° C./90% RH) for 48 hours and then in a very high temperature and humidity SHH (35.0° C./85% RH) environment for 24 hours. After that, the evaluation was performed in the very high temperature and humidity SHH environment as described above.

Evaluation of Image Density

The image density was measured with a Macbeth densitometer (RD-914: manufactured by Macbeth) equipped with an SPI auxiliary filter.

The evaluation criteria for image density are as follows:

A: 1.45 or more

B: 1.40 or more and less than 1.45

C: 1.30 or more and less than 1.40

D: 1.25 or more and less than 1.30

E: 1.20 or more and less than 1.25

F: Less than 1.20

Evaluation of Fogging

An image having a printing rate of 0% was printed initially and after 5,000 sheets endurance output. The white level (%) of a white ground portion of the image was measured with a "reflectometer" (manufactured by Tokyo Denshoku. Co., Ltd.). Likewise, the white level (%) of a transferring material that was not used for image formation was measured with the "reflectometer" (manufactured by Tokyo Denshoku. Co., Ltd.). The difference (B−A) between the white level A of the white ground portion of the image and the white level B of the transferring material was considered to be the fogging density (%). On the basis of the fogging density, image fogging was rated as follows:

A: Less than 1.0%

B: 1.0% or more and less than 1.5%

C: 1.5% or more and less than 2.0%

D: 2.0% or more and less than 2.5%

E: 2.5% or more and less than 3.0%

F: 3.0% or more

Evaluation of Soiling of Components

After the 5,000 sheets endurance output, a mix image was printed. The first half of the mix image was a halftone image (toner bearing amount: 0.25 $mg/cm^{2)}$, and the second half of the mix image was a solid image (toner bearing amount: 0.40 $mg/cm^{2)}$. The mix image was rated according to the following criteria:

A: Neither vertical streaks in the paper ejection direction nor dots having different densities are observed on the developing roller and on the halftone portion and solid portion of the image.

B: One or two narrow streaks are observed at both ends of the developing roller in the circumferential direction. In addition or alternatively, 1 or more and 3 or less melt-adhered particles are observed on the photosensitive drum. However, neither vertical streaks in the paper ejection direction nor dots having different densities are observed on the halftone portion and solid portion of the image.

C: 3 or more and 5 or less narrow streaks are observed at both ends of the developing roller in the circumferential direction. In addition or alternatively, 3 or more and 5 or less melt-adhered particles are observed on the photosensitive drum. In addition or alternatively, a very small number of vertical streaks in the paper ejection direction and/or dots having different densities are observed on the halftone portion and solid portion of the image.

D: 6 or more and 20 or less narrow streaks are observed at both ends of the developing roller in the circumferential direction. In addition or alternatively, 6 or more and 20 or less melt-adhered particles are observed on the photosensitive drum. In addition or alternatively, several vertical streaks in the paper ejection direction and/or apparent dots having different densities are observed on the halftone portion and solid portion of the image.

E: 21 or more streaks are observed at both ends of the developing roller in the circumferential direction. In addition or alternatively, 21 or more melt-adhered particles are observed on the photosensitive drum. In addition or alternatively, many streaks and/or dots having different densities are observed on the halftone portion and solid portion of the image.

Evaluation of Low-Temperature Fixability (Low-Temperature Offset Finish Temperature)

The laser-beam printer LBP9600C manufactured by CANON KABUSHIKI KAISHA was modified such that the fixing temperature of the fixing unit could be altered. An unfixed toner image having a toner bearing amount of 0.40 mg/cm$^2$ was fixed with the modified LBP9600C at a process speed of 230 mm/s.

With respect to fixability, a fixed image was rubbed 10 times with a Kimwipe [S-200 (Nippon Paper Crecia Co., Ltd.)] at a load of 75 g/cm$^2$. The temperatures at which the density-decreasing rate due to rubbing was less than 5% was considered to be the low-temperature offset finish temperature. The evaluation was performed at normal temperature and humidity (25° C./50% RH).

Evaluation of Storage Stability

Evaluation of Storage Characteristics

After 10 g of toner in a 100-mL vial was left to stand at a temperature of 50° C. and at a humidity of 20% for 15 days, the toner was visually inspected.

A: No change
B: Friable agglomerates are observed.
C: Nonfriable agglomerates are observed.
D: No flowability
E: Apparent caking Evaluation of Long-Term Storage Stability After 10 g of toner in a 100-mL vial was left to stand at a temperature of 45° C. and at a humidity of 95% for 3 months, the toner was visually inspected.

A: No change
B: Friable agglomerates are observed.
C: Nonfriable agglomerates are observed.
D: No flowability
E: Apparent caking Evaluation of Density Difference D(1–10) in Continuous Printing After 5,000 sheets were output, a solid image (toner bearing amount: 0.40 mg/cm$^2$) was continuously printed on 10 sheets. A difference in image density between the first sheet and the 10th sheet was measured.

Density difference $D(1-10)$=(Solid image density of first sheet)−(Solid image density of 10th sheet)

A: Less than 0.05
B: 0.05 or more and less than 0.10
C: 0.10 or more and less than 0.15
D: 0.15 or more and less than 0.20
E: 0.20 or more Evaluation Using Toner Particles 1

The evaluation was performed as described above except that the toner particles 1 were used. Table 9 shows the results. The toner 1 and the toner particles 1 had substantially the same evaluation results.

Formation of Full-Color Image

A toner cartridge of a tandem system laser-beam printer LBP9600C manufactured by CANON KABUSHIKI KAISHA as illustrated in FIG. 4 was charged with 200 g of the toner 1 (cyan). Likewise, each toner cartridge of LBP9600C was charged with 200 g of toner 27 (black), toner 28 (magenta), or toner 29 (yellow). The four color cartridges were left to stand in a low temperature and low humidity L/L (10° C./15% RH) environment, in a normal temperature and humidity N/N (25° C./50% RH) environment, or in a high temperature and high humidity H/H (32.5° C./85% RH) environment for 24 hours. After being left to stand in the environments for 24 hours, the cyan, black, magenta, and yellow cartridges were mounted in LBP9600C. An image having a printing rate of 5.0% was printed on 5,000 A4 sheets in the transverse direction. The initial image and the image on the 5,000th sheet were evaluated for the solid image density and fogging. Soiling of components (filming, development stripes, melt-adhesion to drum) after 5,000 sheets output was also evaluated. The results were good.

The four color cartridges were left to stand in a severe environment (40° C./90% RH) for 48 hours and then in a very high temperature and humidity SHH (35.0° C./85% RH) environment for 24 hours. The cyan, black, magenta, and yellow cartridges were then mounted in LBP9600C and were evaluated in the very high temperature and humidity SHH environment as described above. The results were good.

TABLE 1

| Toner particles | | | Toner particles 1 | Toner particles 2 | Toner particles 3 | Toner particles 4 | Toner particles 5 | Toner particles 6 | Toner particles 7 | Toner particles 8 | Toner particles 9 | Toner particles 10 |
|---|---|---|---|---|---|---|---|---|---|---|---|---|
| Monomer | Styrene | Parts by mass | 70.0 | 70.0 | 70.0 | 70.0 | 70.0 | 70.0 | 70.0 | 70.0 | 70.0 | 70.0 |
| | n-Butyl acrylate | Parts by mass | 30.0 | 30.0 | 30.0 | 30.0 | 30.0 | 30.0 | 30.0 | 30.0 | 30.0 | 30.0 |
| | Divinylbenzene | Parts by mass | 0.02 | 0.02 | 0.02 | 0.02 | 0.02 | 0.02 | 0.02 | 0.02 | 0.02 | 0.02 |
| | Silane | Silane 1 | Methyl-triethoxy-silane | Ethyl-triethoxy-silane | n-Propyl-triethoxy-silane | n-Butyl-triethoxy-silane | Phenyl-triethoxy-silane | Vinyl-triethoxy-silane | 3-Methacryloxy-propyl-triethoxy-silane | Methyl-trimethoxy-silane | Methyl-triisopropoxy-silane | Methyl-diethoxychloro-silane |
| | | Silane 1 parts by mass | 7.5 | 7.5 | 7.5 | 7.5 | 7.5 | 7.5 | 7.5 | 7.5 | 7.5 | 7.5 |
| | | Silane 2 | — | — | — | — | — | — | — | — | — | — |
| | | Silane 2 parts by mass | — | — | — | — | — | — | — | — | — | — |
| Polyester resin | | Type | (1) | (1) | (1) | (1) | (1) | (1) | (1) | (1) | (1) | (1) |
| | | Parts by mass | 5.0 | 5.0 | 5.0 | 5.0 | 5.0 | 5.0 | 5.0 | 5.0 | 5.0 | 5.0 |
| Release agent | | Type | Behenyl behenate | Behenyl behenate | Behenyl behenate | Behenyl behenate | Behenyl behenate | Behenyl behenate | Behenyl behenate | Behenyl behenate | Behenyl behenate | Behenyl behenate |
| | | Parts by mass | 12.5 | 12.5 | 12.5 | 12.5 | 12.5 | 12.5 | 12.5 | 12.5 | 12.5 | 12.5 |
| | | Melting point (° C.) | 72.1 | 72.1 | 72.1 | 72.1 | 72.1 | 72.1 | 72.1 | 72.1 | 72.1 | 72.1 |
| | | Amount of heat absorption (J/g) | 210.3 | 210.3 | 210.3 | 210.3 | 210.3 | 210.3 | 210.3 | 210.3 | 210.3 | 210.3 |
| Colorant | | Type of colorant | P.B. 15:3 | P.B. 15:3 | P.B. 15:3 | P.B. 15:3 | P.B. 15:3 | P.B. 15:3 | P.B. 15:3 | P.B. 15:3 | P.B. 15:3 | P.B. 15:3 |
| | | Parts by mass | 6.5 | 6.5 | 6.5 | 6.5 | 6.5 | 6.5 | 6.5 | 6.5 | 6.5 | 6.5 |
| Charge control resin 1 | | Parts by mass | 0.3 | 0.3 | 0.3 | 0.3 | 0.3 | 0.3 | 0.3 | 0.3 | 0.3 | 0.3 |
| Charge control agent 1 | | Parts by mass | 0.3 | 0.3 | 0.3 | 0.3 | 0.3 | 0.3 | 0.3 | 0.3 | 0.3 | 0.3 |
| Oil-soluble initiator | Type | | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate |
| | Addition amount | Parts by mass | 14.0 | 14.0 | 14.0 | 14.0 | 14.0 | 14.0 | 14.0 | 14.0 | 14.0 | 14.0 |
| Polymer-ization conditions | Reaction 1 | Temperature | 70 | 70 | 70 | 70 | 70 | 70 | 70 | 70 | 70 | 70 |
| | | Holding time (hours) | 5 h | 5 h | 5 h | 5 h | 5 h | 5 h | 5 h | 5 h | 5 h | 5 h |
| | | pH | 5.1 | 5.1 | 5.1 | 5.1 | 5.1 | 5.1 | 5.1 | 5.1 | 5.1 | 5.1 |
| | Reaction 2 | Temperature | 85 | 85 | 85 | 85 | 85 | 85 | 85 | 85 | 85 | 85 |
| | | Holding time (hours) | 5 h | 5 h | 5 h | 5 h | 5 h | 5 h | 5 h | 5 h | 5 h | 5 h |
| | | pH | 7.0 | 7.0 | 7.0 | 7.0 | 7.0 | 7.0 | 7.0 | 7.0 | 7.0 | 7.0 |
| | Reaction 3 | Temperature | 100 | 100 | 100 | 100 | 100 | 100 | 100 | 100 | 100 | 100 |
| | | Holding time (hours) | 5 h | 5 h | 5 h | 5 h | 5 h | 5 h | 5 h | 5 h | 5 h | 5 h |
| | | pH | 7.0 | 7.0 | 7.0 | 7.0 | 7.0 | 7.0 | 7.0 | 7.0 | 7.0 | 7.0 |
| Toner physical properties | THF-insoluble matter (%) | | 2.4 | 2.2 | 2.1 | 2.3 | 2.3 | 15.4 | 16.2 | 2.2 | 2.4 | 2.3 |
| | Average circularity | | 0.982 | 0.982 | 0.981 | 0.982 | 0.982 | 0.982 | 0.981 | 0.982 | 0.981 | 0.982 |
| | Mode circularity | | 1.00 | 1.00 | 1.00 | 1.00 | 1.00 | 1.00 | 1.00 | 1.00 | 1.00 | 1.00 |
| | Weight-average molecular weight of toner particles | | 29800 | 29200 | 29400 | 29600 | 29800 | 36300 | 36200 | 29300 | 29400 | 29100 |

TABLE 1-continued

| Toner particles | Toner particles 1 | Toner particles 2 | Toner particles 3 | Toner particles 4 | Toner particles 5 | Toner particles 6 | Toner particles 7 | Toner particles 8 | Toner particles 9 | Toner particles 10 |
|---|---|---|---|---|---|---|---|---|---|---|
| Weight-average molecular weight/number-average molecular weight of toner particles | 8.9 | 9.1 | 9.2 | 9.2 | 9.2 | 11.4 | 11.3 | 9.1 | 9.2 | 9.3 |
| Circle-equivalent diameter Dtem calculated from cross-sectional area of toner (μm) | 5.6 | 5.6 | 5.7 | 5.6 | 5.7 | 5.6 | 5.6 | 5.6 | 5.7 | 5.5 |
| Weight-average particle diameter (μm) | 5.6 | 5.5 | 5.6 | 5.6 | 5.6 | 5.6 | 5.6 | 5.6 | 5.6 | 5.6 |
| Number-average particle size (μm) | 5.2 | 5.2 | 5.2 | 5.2 | 5.2 | 5.2 | 5.2 | 5.2 | 5.2 | 5.2 |
| Endothermic main peak temperature (° C.) | 70.3 | 70.5 | 70.5 | 70.5 | 70.5 | 70.5 | 70.4 | 70.4 | 70.3 | 70.4 |
| Integral heat quantity (J/g) | 22.4 | 22.3 | 22.6 | 22.5 | 22.6 | 22.3 | 22.4 | 22.5 | 22.3 | 22.4 |
| Glass transition point (° C.) | 48.2 | 48.6 | 48.4 | 48.2 | 48.7 | 48.2 | 48.2 | 48.3 | 48.4 | 48.6 |
| Flow tester 80° C. viscosity (Pa · S) | 18000 | 18100 | 18200 | 18200 | 18200 | 18600 | 18600 | 18100 | 18100 | 18200 |

TABLE 2

| Toner particles | | | Toner particles 11 | Toner particles 12 | Toner particles 13 | Toner particles 14 | Toner particles 15 | Toner particles 16 | Toner particles 17 | Toner particles 18 | Toner particles 19 | Toner particles 20 |
|---|---|---|---|---|---|---|---|---|---|---|---|---|
| Monomer | Styrene | Parts by mass | 70.0 | 70.0 | 70.0 | 70.0 | 70.0 | 70.0 | 70.0 | 70.0 | 70.0 | 70.0 |
| | n-Butyl acrylate | Parts by mass | 30.0 | 30.0 | 30.0 | 30.0 | 30.0 | 30.0 | 30.0 | 30.0 | 30.0 | 30.0 |
| | Divinylbenzene | Parts by mass | 0.02 | 0.02 | 0.02 | 0.02 | 0.02 | 0.02 | 0.02 | 0.02 | 0.02 | 0.02 |
| | Silane | Silane 1 | Methyl-triethoxy-silane | Methyl-triethoxy-silane | Methyl-triethoxy-silane | Methyl-triethoxy-silane | Methyl-triethoxy-silane | Methyl-triethoxy-silane | Methyl-triethoxy-silane | Methyl-triethoxy-silane | Methyl-triethoxy-silane | Methyl-triethoxy-silane |
| | | Silane 1 parts by mass | 5.0 | 1.5 | 7.5 | 7.5 | 7.5 | 7.5 | 7.5 | 4.0 | 4.0 | 4.0 |
| | | Silane 2 | — | — | — | — | — | — | — | Tetraethoxy-silane | Vinyltriethoxy-silane | 3-Methacryloxy-propyl-trimethoxy-silane |
| | | Silane 2 parts by mass | — | — | — | — | — | — | — | 4.4 | 3.5 | 3.4 |
| Polyester resin | | Type | (1) | (1) | (1) | (1) | (1) | (1) | (1) | (1) | (1) | (1) |
| | | Parts by mass | 5.0 | 5.0 | 5.0 | 5.0 | 5.0 | 5.0 | 5.0 | 5.0 | 5.0 | 5.0 |
| Release agent | | Type | Behenyl behenate | Behenyl behenate | Behenyl behenate | Behenyl behenate | Behenyl behenate | Behenyl behenate | Behenyl behenate | Behenyl behenate | Behenyl behenate | Behenyl behenate |
| | | Parts by mass | 12.5 | 12.5 | 12.5 | 12.5 | 12.5 | 12.5 | 12.5 | 12.5 | 12.5 | 12.5 |
| | | Melting point (° C.) | 72.1 | 72.1 | 72.1 | 72.1 | 72.1 | 72.1 | 72.1 | 72.1 | 72.1 | 72.1 |
| | | Amount of heat absorption (J/g) | 210.3 | 210.3 | 210.3 | 210.3 | 210.3 | 210.3 | 210.3 | 210.3 | 210.3 | 210.3 |
| Colorant | | Type of colorant | P.B. 15:3 | P.B. 15:3 | P.B. 15:3 | P.B. 15:3 | P.B. 15:3 | P.B. 15:3 | P.B. 15:3 | P.B. 15:3 | P.B. 15:3 | P.B. 15:3 |
| | | Parts by mass | 6.5 | 6.5 | 6.5 | 6.5 | 6.5 | 6.5 | 6.5 | 6.5 | 6.5 | 6.5 |
| Charge control resin 1 | | Parts by mass | 0.3 | 0.3 | 0.3 | 0.3 | 0.3 | 0.3 | 0.3 | 0.3 | 0.3 | 0.3 |
| Charge control agent 1 | | Parts by mass | 0.3 | 0.3 | 0.3 | 0.3 | 0.3 | 0.3 | 0.3 | 0.3 | 0.3 | 0.3 |
| Oil-soluble initiator | | Type | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate |
| | Addition amount | Parts by mass | 14.0 | 14.0 | 14.0 | 14.0 | 14.0 | 14.0 | 14.0 | 14.0 | 14.0 | 14.0 |
| Polymer-ization conditions | Reaction 1 | Temperature | 70 | 70 | 70 | 70 | 70 | 70 | 70 | 70 | 70 | 70 |
| | | Holding time (hours) | 5 h | 5 h | 5 h | 5 h | 5 h | 5 h | 5 h | 5 h | 5 h | 5 h |
| | | pH | 5.1 | 5.1 | 5.1 | 5.1 | 5.1 | 5.1 | 5.1 | 5.1 | 5.1 | 5.1 |
| | Reaction 2 | Temperature | 85 | 85 | 85 | 85 | 85 | 85 | 85 | 85 | 85 | 85 |
| | | Holding time (hours) | 5 h | 5 h | 5 h | 5 h | 5 h | 5 h | 5 h | 5 h | 5 h | 5 h |
| | | pH | 7.0 | 7.0 | 3.8 | 4.2 | 8.9 | 10.0 | 10.4 | 7.0 | 7.0 | 7.0 |
| | Reaction 3 | Temperature | 100 | 100 | 100 | 100 | 100 | 100 | 100 | 100 | 100 | 100 |
| | | Holding time (hours) | 5 h | 5 h | 5 h | 5 h | 5 h | 5 h | 5 h | 5 h | 5 h | 5 h |
| | | pH | 7.0 | 7.0 | 3.8 | 4.2 | 8.9 | 10.0 | 10.4 | 7.0 | 7.0 | 7.0 |
| Toner physical properties | THF-insoluble matter (%) | | 2.3 | 2.2 | 2.1 | 2.2 | 2.4 | 2.3 | 2.3 | 2.2 | 18.4 | 18.6 |
| | Average circularity | | 0.982 | 0.981 | 0.981 | 0.980 | 0.981 | 0.981 | 0.982 | 0.981 | 0.973 | 0.980 |
| | Mode circularity | | 1.00 | 1.00 | 1.00 | 1.00 | 1.00 | 1.00 | 1.00 | 1.00 | 1.00 | 1.00 |

TABLE 2-continued

| Toner particles | Toner particles 11 | Toner particles 12 | Toner particles 13 | Toner particles 14 | Toner particles 15 | Toner particles 16 | Toner particles 17 | Toner particles 18 | Toner particles 19 | Toner particles 20 |
|---|---|---|---|---|---|---|---|---|---|---|
| Weight-average molecular weight of toner particles | 29000 | 28800 | 29300 | 29200 | 29400 | 29100 | 29000 | 29100 | 34200 | 34800 |
| Weight-average molecular weight/number-average molecular weight of toner particles | 9.3 | 9.2 | 9.3 | 9.2 | 9.2 | 9.2 | 9.3 | 9.3 | 9.2 | 9.3 |
| Circle-equivalent diameter Dtem calculated from cross-sectional area of toner (μm) | 5.5 | 5.5 | 5.5 | 5.5 | 5.6 | 5.6 | 5.6 | 5.5 | 5.6 | 5.6 |
| Weight-average particle diameter (μm) | 5.6 | 5.6 | 5.6 | 5.6 | 5.6 | 5.6 | 5.6 | 5.6 | 5.6 | 5.6 |
| Number-average particle size (μm) | 5.2 | 5.2 | 5.2 | 5.2 | 5.3 | 5.2 | 5.2 | 5.2 | 5.2 | 5.2 |
| Endothermic main peak temperature (° C.) | 70.4 | 70.4 | 70.2 | 70.6 | 70.7 | 70.6 | 70.5 | 70.4 | 70.4 | 70.3 |
| Integral heat quantity (J/g) | 22.6 | 22.4 | 22.4 | 22.3 | 22.5 | 22.4 | 22.4 | 22.3 | 22.4 | 22.3 |
| Glass transition point (° C.) | 48.7 | 48.6 | 48.3 | 48.4 | 48.6 | 48.6 | 48.9 | 48.7 | 48.6 | 48.8 |
| Flow tester 80° C. viscosity (Pa · S) | 18200 | 18100 | 18000 | 18100 | 18200 | 18200 | 18400 | 18200 | 18100 | 18000 |

TABLE 3

| Toner particles | | | Toner particles 21 | Toner particles 22 | Toner particles 23 | Toner particles 24 | Toner particles 25 | Toner particles 26 | Toner particles 27 | Toner particles 28 | Toner particles 29 |
|---|---|---|---|---|---|---|---|---|---|---|---|
| Monomer | Styrene | Parts by mass | 70.0 | 70.0 | Described in specification | Described in specification | Described in specification | 62.0 | 70.0 | 70.0 | 70.0 |
| | n-Butyl acrylate | Parts by mass | 30.0 | 30.0 | | | | 38.0 | 30.0 | 30.0 | 30.0 |
| | Divinylbenzene | Parts by mass | 0.02 | 0.02 | | | | 0.02 | 0.02 | 0.02 | 0.02 |
| | Silane | Silane 1 | Methyltriethoxy-silane | Methyltriethoxy-silane | | | | Methyltriethoxy-silane | Methyltriethoxy-silane | Methyltriethoxy-silane | Methyltriethoxy-silane |
| | | Silane 1 parts by mass | 7.5 | 7.5 | | | | 5.5 | 7.5 | 7.5 | 7.5 |
| | | Silane 2 | — | — | | | | Dimethyldiethoxy-silane, titanium tetra-n-butoxide | — | — | — |
| | | Silane 2 parts by mass | — | — | | | | 1.0, 1.0 | — | — | — |
| Polyester resin | | Type | (1) | (1) | | | | (1) | (1) | (1) | (1) |
| | | Parts by mass | 5.0 | 5.0 | | | | 5.0 | 5.0 | 5.0 | 5.0 |
| Release agent | | Type | Behenyl behenate | Behenyl behenate | | | | Behenyl behenate | Behenyl behenate | Behenyl behenate | Behenyl behenate |
| | | Parts by mass | 12.5 | 12.5 | | | | 12.5 | 12.5 | 12.5 | 12.5 |
| | | Melting point (° C.) | 72.1 | 72.1 | | | | 72.1 | 72.1 | 72.1 | 72.1 |
| | | Amount of heat absorption (J/g) | 210.3 | 210.3 | | | | 210.3 | 210.3 | 210.3 | 210.3 |
| Colorant | | Type of colorant | P.B. 15:3 | P.B. 15:3 | | | | P.B. 15:3 | Carbon black | P.R. 122 | P.Y. 155 |
| | | Parts by mass | 6.5 | 6.5 | | | | 6.5 | 10 | 8.0 | 6.0 |
| Charge control resin 1 | | Parts by mass | 0.3 | 0.3 | | | | 0.3 | 0.3 | 0.3 | 0.3 |
| Charge control agent 1 | | Parts by mass | 0.3 | 0.3 | | | | 0.3 | 0.3 | 0.3 | 0.3 |
| Oil-soluble initiator | Type | | t-Butyl peroxypivalate | t-Butyl peroxypivalate | | | | t-Butyl peroxypivalate | t-Butyl peroxypivalate | t-Butyl peroxypivalate | t-Butyl peroxypivalate |
| | Addition amount | Parts by mass | 14.0 | 14.0 | | | | 14.0 | 14.0 | 14.0 | 14.0 |
| Polymerization conditions | Reaction 1 | Temperature | 70 | 70 | | | | 70 | 70 | 70 | 70 |
| | | Holding time (hours) | 5 h | 5 h | | | | 5 h | 5 h | 5 h | 5 h |
| | | pH | 5.1 | 5.1 | | | | 5.1 | 5.1 | 5.1 | 5.1 |
| | Reaction 2 | Temperature | 85 | 85 | | | | 85 | 85 | 85 | 85 |
| | | Holding time (hours) | 10 h | 5 h | | | | 5 h | 5 h | 5 h | 5 h |
| | | pH | 7.0 | 7.0 | | | | 7.0 | 7.0 | 7.0 | 7.0 |
| | Reaction 3 | Temperature | — | 104 | | | | 100 | 100 | 100 | 100 |
| | | Holding time (hours) | | 5 h | | | | 5 h | 5 h | 5 h | 5 h |
| | | pH | | 7.0 | | | | 7.0 | 7.0 | 7.0 | 7.0 |
| Toner physical properties | THF-insoluble matter (%) | | 2.2 | 2.2 | 26.2 | 24.5 | 9.4 | 2.1 | 2.2 | 2.2 | 2.3 |
| | Average circularity | | 0.981 | 0.984 | 0.975 | 0.976 | 0.964 | 0.980 | 0.981 | 0.979 | 0.981 |
| | Mode circularity | | 1.00 | 1.00 | 0.99 | 1.00 | 0.98 | 1.00 | 1.00 | 1.00 | 1.00 |
| | Weight-average molecular weight of toner particles | | 29400 | 26200 | 36200 | 31800 | 41200 | 28900 | 29000 | 28900 | 29100 |

TABLE 3-continued

| Toner particles | Toner particles 21 | Toner particles 22 | Toner particles 23 | Toner particles 24 | Toner particles 25 | Toner particles 26 | Toner particles 27 | Toner particles 28 | Toner particles 29 |
|---|---|---|---|---|---|---|---|---|---|
| Weight-average molecular weight/number-average molecular weight of toner particles | 9.2 | 8.9 | 16.8 | 16.6 | 19.8 | 8.7 | 9.2 | 9.1 | 9.0 |
| Circle-equivalent diameter Dtem calculated from cross-sectional area of toner (μm) | 5.6 | 5.6 | 5.6 | 5.6 | 5.6 | 5.6 | 5.7 | 5.6 | 5.6 |
| Weight-average particle diameter (μm) | 5.6 | 5.6 | 5.5 | 5.6 | 5.5 | 5.6 | 5.6 | 5.6 | 5.6 |
| Number-average particle size (μm) | 5.2 | 5.2 | 5.2 | 5.2 | 5.2 | 5.2 | 5.1 | 5.1 | 5.2 |
| Endothermic main peak temperature (° C.) | 70.4 | 70.3 | 70.4 | 70.4 | 70.4 | 70.4 | 70.3 | 70.3 | 70.3 |
| Integral heat quantity (J/g) | 22.5 | 21.2 | 22.4 | 22.3 | 22.3 | 22.3 | 22.4 | 22.5 | 22.3 |
| Glass transition point (° C.) | 48.9 | 47.6 | 51.2 | 50.2 | 47.6 | 48.6 | 48.9 | 48.7 | 48.2 |
| Flow tester 80° C. viscosity (Pa · S) | 18200 | 17100 | 17000 | 23400 | 15300 | 18300 | 18200 | 18200 | 18100 |

TABLE 4

| Toner particles | | | Comparative toner particles 1 | Comparative toner particles 2 | Comparative toner particles 3 | Comparative toner particles 4 | Comparative toner particles 5 | Comparative toner particles 6 | Comparative toner particles 7 | Comparative toner particles 8 | Comparative toner particles 9 | Comparative toner particles 10 |
|---|---|---|---|---|---|---|---|---|---|---|---|---|
| Monomer | Styrene | Parts by mass | 70.0 | 70.0 | 70.0 | 70.0 | 70.0 | 70.0 | 70.0 | 70.0 | 70.0 | Described in specification |
| | n-Butyl acrylate | Parts by mass | 30.0 | 30.0 | 30.0 | 30.0 | 30.0 | 30.0 | 30.0 | 30.0 | 30.0 | |
| | Divinylbenzene | Parts by mass | 0.02 | 0.02 | 0.02 | 0.02 | 0.02 | 0.02 | 0.02 | 0.02 | 0.10 | |
| | Silane | Silane 1 | Methyltriethoxy-silane | Tetraethoxy-silane | 3-Methacryloxy-propyltriethoxy-silane | 3-Methacryloxy-propyltriethoxy-silane | 3-Methacryloxy-propyltriethoxy-silane | 3-Methacryloxy-propyltriethoxy-silane | 3-Methacryloxy-propyltriethoxy-silane | Aminopropyltri-methoxysilane | — | |
| | | Silane 1 parts by mass | 1.5 | 7.5 | 7.5 | 7.5 | 7.5 | 15.0 | 3.0 | 7.5 | — | |
| | | Silane 2 | — | — | — | — | — | — | | — | — | |
| | | Silane 2 parts by mass | — | — | — | — | — | — | | — | — | |
| Polyester resin | | Type | (1) | (1) | (1) | (1) | (1) | (1) | (1) | (1) | (1) | |
| | | Parts by mass | 5.0 | 5.0 | 5.0 | 5.0 | 5.0 | 5.0 | 5.0 | 5.0 | 5.0 | |
| Release agent | | Type | Behenyl behenate | Behenyl behenate | Behenyl behenate | Behenyl behenate | Behenyl behenate | Behenyl behenate | Behenyl behenate | Behenyl behenate | Behenyl behenate | |
| | | Parts by mass | 12.5 | 12.5 | 12.5 | 12.5 | 12.5 | 12.5 | 12.5 | 12.5 | 12.5 | |
| | | Melting point (° C.) | 72.1 | 72.1 | 72.1 | 72.1 | 72.1 | 72.1 | 72.1 | 72.1 | 72.1 | |
| | | Amount of heat absorption (J/g) | 210.3 | 210.3 | 210.3 | 210.3 | 210.3 | 210.3 | 210.3 | 210.3 | 210.3 | |
| Colorant | | Type of colorant | P.B. 15:3 | P.B. 15:3 | P.B. 15:3 | P.B. 15:3 | P.B. 15:3 | P.B. 15:3 | P.B. 15:3 | P.B. 15:3 | P.B. 15:3 | |
| | | Parts by mass | 6.5 | 6.5 | 6.5 | 6.5 | 6.5 | 6.5 | 6.5 | 6.5 | 6.5 | |
| Charge control resin 1 | | Parts by mass | 0.3 | 0.3 | 0.3 | 0.3 | 0.3 | 0.3 | 0.3 | 0.3 | 0.3 | |
| Charge control agent 1 | | Parts by mass | 0.3 | 0.3 | 0.3 | 0.3 | 0.3 | 0.3 | 0.3 | 0.3 | 0.3 | |
| Oil-soluble initiator | | Type | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | t-Butyl peroxy-pivalate | |
| | Addition amount | Parts by mass | 14.0 | 14.0 | 14.0 | 14.0 | 14.0 | 14.0 | 14.0 | 14.0 | 14.0 | |
| Polymer-ization conditions | Reaction 1 | Temperature | 30 | 30 | 30 | 30 | 70 | 30 | 30 | 30 | 70 | |
| | | Holding time (hours) | 5 h | 5 h | 5 h | 5 h | 5 h | 5 h | 5 h | 5 h | 5 h | |
| | | pH | 5.1 | 5.1 | 5.1 | 5.1 | 5.1 | 5.1 | 5.1 | 5.1 | 5.1 | |
| | Reaction 2 | Temperature | 30 | 30 | 30 | 70 | 70 | 70 | 70 | 70 | 85 | |
| | | Holding time (hours) | 5 h | 5 h | 5 h | 5 h | 5 h | 5 h | 5 h | 5 h | 5 h | |
| | | pH | 5.1 | 5.1 | 5.1 | 5.1 | 5.1 | 5.1 | 5.1 | 5.1 | 7.0 | |
| | Reaction 3 | Temperature | — | — | — | — | — | — | — | — | 100 | |
| | | Holding time (hours) | | | | | | | | | 5 h | |
| | | pH | | | | | | | | | 7.0 | |

TABLE 4-continued

| | Toner particles | Comparative toner particles 1 | Comparative toner particles 2 | Comparative toner particles 3 | Comparative toner particles 4 | Comparative toner particles 5 | Comparative toner particles 6 | Comparative toner particles 7 | Comparative toner particles 8 | Comparative toner particles 9 | Comparative toner particles 10 |
|---|---|---|---|---|---|---|---|---|---|---|---|
| Toner physical properties | THF-insoluble matter (%) | 2.2 | 2.2 | 21.2 | 22.2 | 23.4 | 24.3 | 14.2 | 2.6 | 2.4 | 12.1 |
| | Average circularity | 0.981 | 0.981 | 0.980 | 0.980 | 0.980 | 0.981 | 0.981 | 0.982 | 0.980 | 0.981 |
| | Mode circularity | 1.00 | 1.00 | 1.00 | 1.00 | 1.00 | 1.00 | 1.00 | 1.00 | 1.00 | 1.00 |
| | Weight-average molecular weight of toner particles | 29400 | 28700 | 33200 | 32400 | 32800 | 36700 | 31200 | 29600 | 29400 | 29200 |
| | Weight-average molecular weight/number-average molecular weight of toner particles | 9.1 | 10.9 | 10.8 | 11.2 | 11.1 | 10.9 | 10.6 | 9.3 | 11.9 | 10.2 |
| | Circle-equivalent diameter Dtem calculated from cross-sectional area of toner (μm) | 5.6 | 5.6 | 5.6 | 5.6 | 5.6 | 5.6 | 5.6 | 5.6 | 5.6 | 5.7 |
| | Weight-average particle diameter (μm) | 5.7 | 5.6 | 5.6 | 5.6 | 5.6 | 5.6 | 5.6 | 5.6 | 5.6 | 5.6 |
| | Number-average particle size (μm) | 5.2 | 5.2 | 5.3 | 5.2 | 5.2 | 5.2 | 5.8 | 7.9 | 5.8 | 7.1 |
| | Endothermic main peak temperature (° C.) | 70.4 | 70.5 | 70.6 | 70.5 | 70.5 | 70.4 | 70.4 | 70.4 | 70.4 | 70.6 |
| | Integral heat quantity (J/g) | 22.4 | 22.3 | 22.3 | 22.4 | 22.5 | 22.4 | 22.3 | 22.4 | 22.3 | 22.4 |
| | Glass transition point (° C.) | 48.9 | 48.6 | 48.2 | 48.7 | 48.6 | 48.7 | 48.6 | 48.6 | 48.7 | 49.7 |
| | Flow tester 80° C. viscosity (Pa · S) | 18100 | 19200 | 18500 | 18600 | 18500 | 18600 | 18400 | 18200 | 17800 | 18900 |

TABLE 5

| Toner particle No. | $R^5$ in formula (2) | Number of carbon atoms of $R^5$ in formula (2) | $R^6$, $R^7$, $R^8$ in formula (2) | Percentage of number of silicon atoms in partial structure TX formed by polymerization of formula (2) in organosilicon polymer (NTX/NSi) × 100 (mol %) | Average thickness Dav. of surface layer containing organosilicon polymer (nm) | Silicon concentration of toner particle surface in ESCA measurement (atomic %) |
|---|---|---|---|---|---|---|
| Toner particles 1 | Methyl group | 1 | Ethoxy group | 100 | 33.5 | 25.5 |
| Toner particles 2 | Ethyl group | 2 | Ethoxy group | 100 | 6.2 | 15.5 |
| Toner particles 3 | n-Propyl group | 3 | Ethoxy group | 100 | 5.4 | 14.9 |
| Toner particles 4 | n-Butyl group | 4 | Ethoxy group | 100 | 4.6 | 11.4 |
| Toner particles 5 | Phenyl group | 6 | Ethoxy group | 100 | 10.1 | 10.5 |
| Toner particles 6 | Vinyl group | 2 | Ethoxy group | 100 | 36.4 | 15.4 |
| Toner particles 7 | Methacryloxypropyl group | 7 | Ethoxy group | 100 | 3.7 | 25.4 |
| Toner particles 8 | Methyl group | 1 | Methoxy group | 100 | 32.4 | 25.4 |
| Toner particles 9 | Methyl group | 1 | Isopropoxy group | 100 | 32.1 | 24.5 |
| Toner particles 10 | Methyl group | 1 | Chloro group, ethoxy group | 100 | 31.9 | 24.2 |
| Toner particles 11 | Methyl group | 1 | Ethoxy group | 100 | 57.4 | 25.6 |
| Toner particles 12 | Methyl group | 1 | Ethoxy group | 100 | 5.2 | 2.6 |
| Toner particles 13 | Methyl group | 1 | Ethoxy group | 100 | 18.2 | 18.4 |
| Toner particles 14 | Methyl group | 1 | Ethoxy group | 100 | 30.2 | 23.4 |
| Toner particles 15 | Methyl group | 1 | Ethoxy group | 100 | 36.2 | 25.5 |
| Toner particles 16 | Methyl group | 1 | Ethoxy group | 100 | 36.2 | 25.5 |
| Toner particles 17 | Methyl group | 1 | Ethoxy group | 100 | 26.2 | 19.4 |
| Toner particles 18 | Methyl group | 1 | Ethoxy group, ethoxy group | 54 | 30.2 | 24.2 |
| Toner particles 19 | Methyl group, vinyl group | 1, 2 | Ethoxy group, methoxy group | 53 | 34.3 | 12.4 |
| Toner particles 20 | Methyl group, methacryloxypropyl group | 1, 7 | Ethoxy group | 57 | 24.3 | 9.8 |
| Toner particles 21 | Methyl group | 1 | Ethoxy group | 100 | 34.2 | 25.7 |
| Toner particles 22 | Methyl group | 1 | Ethoxy group | 100 | 33.5 | 25.5 |
| Toner particles 23 | Methyl group | 1 | Ethoxy group | 100 | 33.4 | 25.5 |
| Toner particles 24 | Methyl group | 1 | Ethoxy group | 100 | 33.6 | 19.8 |
| Toner particles 25 | Methyl group | 1 | Ethoxy group | 100 | 33.2 | 19.7 |
| Toner particles 26 | Methyl group | 1 | Ethoxy group | 100 | 30.2 | 23.7 |
| Toner particles 27 | Methyl group | 1 | Ethoxy group | 100 | 33.4 | 25.1 |
| Toner particles 28 | Methyl group | 1 | Ethoxy group | 100 | 33.2 | 25.6 |
| Toner particles 29 | Methyl group | 1 | Ethoxy group | 100 | 33.2 | 25.7 |

TABLE 6

| Toner particle No. | $R^5$ in formula (2) | Number of carbon atoms of $R^5$ in formula (2) | $R^6$, $R^7$, $R^8$ in formula (2) | Percentage of number of silicon atoms in partial structure TX formed by polymerization of formula (2) in organosilicon polymer (NTX/NSi) × 100 (mol %) | Average thickness Dav. of surface layer containing organosilicon polymer (μm) | Silicon concentration of toner particle surface in ESCA measurement (atomic %) |
|---|---|---|---|---|---|---|
| Comparative toner particles 1 | Methyl group | 1 | Ethoxy group | 100 | 1.2 | 2.3 |
| Comparative toner particles 2 | None | 1 | Ethoxy group | 100 | 12.4 | 19.2 |
| Comparative toner particles 3 | 3-Methacryloxypropyl group | 7 | Ethoxy group | 100 | 3.6 | 4.5 |
| Comparative toner particles 4 | 3-Methacryloxypropyl group | 7 | Ethoxy group | 100 | 3.2 | 4.2 |
| Comparative toner particles 5 | 3-Methacryloxypropyl group | 7 | Ethoxy group | 100 | 3.5 | 4.3 |
| Comparative toner particles 6 | 3-Methacryloxypropyl group | 7 | Ethoxy group | 100 | 4.6 | 6.2 |
| Comparative toner particles 7 | 3-Methacryloxypropyl group | 7 | Ethoxy group | 100 | 1.3 | 2.4 |
| Comparative toner particles 8 | Aminopropyl-trimethoxysilane | — | Methoxy group | 0.00 | 1.3 | 2 |
| Comparative toner particles 9 | — | — | — | 0 | 0.0 | 0 |
| Comparative toner particles 10 | Methyl group | 0, 1 | Ethoxy group | 13 | 4.5 | 2.6 |

TABLE 7

| | | | | Toner 1 | Toner 2 | Toner 3 | Toner 4 | Toner 5 | Toner 6 | Toner 7 | Toner 8 | Toner 9 | Toner 10 |
|---|---|---|---|---|---|---|---|---|---|---|---|---|---|
| Heat resistance | | | Storage stability (50° C./15 day) | A | A | B | C | B | A | C | A | A | A |
| | | | Long-term storage stability (45° C./95% 3 months) | A | B | C | C | B | A | C | A | A | A |
| Environmental stability | NN | Initial | NN fogging | 0.2(A) | 0.3(A) | 0.4(A) | 0.8(A) | 0.5(A) | 0.3(A) | 1.2(B) | 0.2(A) | 0.3(A) | 0.4(A) |
| | | | Density | 1.50(A) | 1.46(A) | 1.45(A) | 1.44(B) | 1.43(B) | 1.47(A) | 1.40(B) | 1.49(A) | 1.49(A) | 1.49(A) |
| | | After 5000-sheet endurance | NN fogging | 0.3(A) | 0.5(A) | 1.1(B) | 1.6(C) | 0.6(A) | 0.3(A) | 1.5(C) | 0.3(A) | 0.3(A) | 0.6(A) |
| | | | Density | 1.50(A) | 1.45(A) | 1.42(B) | 1.41(B) | 1.41(B) | 1.45(A) | 1.38(C) | 1.47(A) | 1.47(A) | 1.47(A) |
| | | | Soiling of components | A | A | A | A | A | A | B | A | A | A |
| | LL | Initial | LL fogging | 0.2(A) | 0.3(A) | 0.4(A) | 0.9(A) | 0.5(A) | 0.4(A) | 1.4(B) | 0.3(A) | 0.3(A) | 0.5(A) |
| | | | Density | 1.50(A) | 1.46(A) | 1.45(A) | 1.43(B) | 1.42(B) | 1.47(A) | 1.40(B) | 1.49(A) | 1.49(A) | 1.49(A) |
| | | After 5000-sheet endurance | LL fogging | 0.4(A) | 0.6(A) | 1.2(B) | 1.7(C) | 0.6(A) | 0.5(A) | 1.7(C) | 0.5(A) | 0.3(A) | 0.7(A) |
| | | | Density | 1.49(A) | 1.44(B) | 1.42(B) | 1.40(B) | 1.40(B) | 1.44(B) | 1.37(C) | 1.45(A) | 1.46(A) | 1.46(A) |
| | | | Soiling of components | A | A | A | A | A | A | B | A | A | A |
| | SHH after left to stand in severe environment for 48 hours | Initial | SHH fogging | 0.5(A) | 0.9(A) | 1.6(C) | 1.9(C) | 1.3(B) | 0.7(A) | 1.8(C) | 1.0(B) | 0.5(A) | 0.9(A) |
| | | | Density | 1.49(A) | 1.40(B) | 1.37(C) | 1.36(C) | 1.45(A) | 1.44(B) | 1.34(0) | 1.38(C) | 1.48(A) | 1.47(A) |
| | | After 5000-sheet endurance | SHH fogging | 0.6(A) | 1.2(B) | 1.8(C) | 1.9(C) | 1.4(B) | 0.7(A) | 1.9(C) | 1.4(B) | 0.7(A) | 1.1(B) |
| | | | Density | 1.47(A) | 1.37(C) | 1.34(C) | 1.33(C) | 1.42(B) | 1.39(C) | 1.30(C) | 1.34(C) | 1.44(B) | 1.43(B) |
| | | | Soiling of components | A | A | B | C | B | A | C | A | A | A |
| | | | Density difference in continuous printing D(1-10) | 0.01(A) | 0.02(A) | 0.02(A) | 0.06(B) | 0.04(A) | 0.02(A) | 0.11(C) | 0.02(A) | 0.02(A) | 0.03(A) |
| Low-temperature offset finish temperature | | | | 105 | 105 | 105 | 105 | 105 | 115 | 125 | 105 | 105 | 105 |

TABLE 8

| | | | | Toner 11 | Toner 12 | Toner 13 | Toner 14 | Toner 15 | Toner 16 | Toner 17 | Toner 18 | Toner 19 | Toner 20 |
|---|---|---|---|---|---|---|---|---|---|---|---|---|---|
| Heat resistance | | | Storage stability (50° C./15 day) | A | B | A | A | A | A | A | A | A | B |
| | | | Long-term storage (45° C./95% 3 months) | A | C | A | A | A | A | C | A | A | C |
| Environmental stability | NN | Initial | NN fogging | 0.4(A) | 0.9(A) | 0.7(A) | 0.3(A) | 0.2(A) | 0.3(A) | 0.5(A) | 0.5(A) | 0.4(A) | 1.1(B) |
| | | | Density | 1.48(A) | 1.47(A) | 1.45(A) | 1.50(A) | 1.50(A) | 1.48(A) | 1.44(A) | 1.47(A) | 1.46(A) | 1.45(A) |
| | | After 5000-sheet endurance | NN fogging | 0.6(A) | 1.2(B) | 0.9(A) | 0.5(A) | 0.3(A) | 0.3(A) | 0.7(A) | 0.7(A) | 0.6(A) | 1.3(B) |
| | | | Density | 1.46(A) | 1.45(A) | 1.42(B) | 1.48(A) | 1.48(A) | 1.48(A) | 1.42(B) | 1.45(A) | 1.44(B) | 1.43(B) |
| | | | Soiling of components | A | A | A | A | A | A | A | A | A | A |
| | LL | Initial | LL fogging | 0.6(A) | 1.2(B) | 0.9(A) | 0.5(A) | 0.5(A) | 0.5(A) | 1.0(B) | 0.3(A) | 0.3(A) | 0.8(A) |
| | | | Density | 1.46(A) | 1.44(B) | 1.42(B) | 1.48(A) | 1.47(A) | 1.46(A) | 1.39(C) | 1.48(A) | 1.47(A) | 1.37(C) |
| | | After 5000-sheet endurance | LL fogging | 0.8(A) | 1.5(C) | 1.0(B) | 0.7(A) | 0.6(A) | 0.8(A) | 1.2(B) | 0.3(A) | 0.3(A) | 0.9(A) |
| | | | Density | 1.43(B) | 1.44(B) | 1.41(B) | 1.46(A) | 1.45(A) | 1.44(B) | 1.37(C) | 1.48(A) | 1.47(A) | 1.36(C) |
| | | | Soiling of components | A | A | A | A | A | A | A | A | A | B |
| | SHH after left to stand in severe environment for 48 hours | Initial | SHH fogging | 1.2(B) | 1.7(C) | 1.4(B) | 0.7(A) | 0.9(A) | 1.6(C) | 1.7(C) | 0.7(A) | 0.7(A) | 1.6(C) |
| | | | Density | 1.42(B) | 1.38(C) | 1.40(B) | 1.46(A) | 1.46(A) | 1.38(C) | 1.37(C) | 1.45(A) | 1.44(B) | 1.36(C) |
| | | After 5000-sheet endurance | SHH fogging | 1.5(C) | 1.9(C) | 1.6(C) | 0.9(A) | 0.9(A) | 1.6(C) | 1.9(C) | 0.7(A) | 0.8(A) | 1.9(C) |
| | | | Density | 1.39(C) | 1.35(C) | 1.38(C) | 1.44(B) | 1.45(A) | 1.36(C) | 1.35(C) | 1.45(A) | 1.44(B) | 1.35(C) |
| | | | Soiling of components | B | B | B | A | A | A | B | A | A | C |
| | | | Density difference in continuous printing D(1-10) | 0.04(A) | 0.13(C) | 0.04(A) | 0.03(A) | 0.02(A) | 0.02(A) | 0.04(A) | 0.04(A) | 0.04(A) | 0.10(C) |
| Low-temperature offset finish temperature | | | | 105 | 105 | 105 | 105 | 105 | 105 | 105 | 115 | 105 | 105 |

TABLE 9

| | | | | Toner 21 | Toner 22 | Toner 23 | Toner 24 | Toner 25 | Toner 26 | Toner 27 | Toner 28 | Toner 29 | Toner particles 1 |
|---|---|---|---|---|---|---|---|---|---|---|---|---|---|
| Heat resistance | | | Storage stability (50° C./15 day) | A | A | A | A | A | A | A | A | A | A |
| | | | Long-term storage (45° C./95% 3 months) | A | B | A | A | A | A | A | A | A | A |
| Environmental stability | NN | Initial | NN fogging | 0.4(A) | 0.2(A) | 0.8(A) | 0.4(A) | 0.4(A) | 0.3(A) | 0.3(A) | 0.3(A) | 0.3(A) | 0.8(A) |
| | | | Density | 1.45(A) | 1.51(A) | 1.46(A) | 1.42(B) | 1.45(A) | 1.43(B) | 1.50(A) | 1.51(A) | 1.50(A) | 1.50(A) |
| | | After 5000-sheet endurance | NN fogging | 0.5(A) | 0.2(A) | 0.9(A) | 0.5(A) | 0.6(A) | 0.4(A) | 0.4(A) | 0.5(A) | 0.5(A) | 1.0(B) |
| | | | Density | 1.42(B) | 1.51(A) | 1.42(B) | 1.38(C) | 1.43(B) | 1.41(B) | 1.47(A) | 1.47(A) | 1.49(A) | 1.48(A) |
| | | | Soiling of components | A | A | A | A | A | A | A | A | A | A |
| | LL | Initial | LL fogging | 0.5(A) | 0.2(A) | 0.9(A) | 0.4(A) | 0.4(A) | 0.4(A) | 0.3(A) | 0.3(A) | 0.2(A) | 0.7(A) |
| | | | Density | 1.44(B) | 1.50(A) | 1.45(A) | 1.40(B) | 1.44(B) | 1.42(B) | 1.51(A) | 1.51(A) | 1.51(A) | 1.51(A) |
| | | After 5000-sheet endurance | LL fogging | 0.6(A) | 0.3(A) | 1.0(B) | 0.6(A) | 0.6(A) | 0.6(A) | 0.4(A) | 0.3(A) | 0.3(A) | 0.9(A) |
| | | | Density | 1.42(B) | 1.49(A) | 1.43(B) | 1.38(C) | 1.42(B) | 1.40(B) | 1.48(A) | 1.50(A) | 1.51(A) | 1.49(A) |
| | | | Soiling of components | A | A | A | A | A | A | A | A | A | A |
| | SHH after left to stand in severe environment for 48 hours | Initial | SHH fogging | 0.6(A) | 0.5(A) | 1.0(B) | 0.8(A) | 0.6(A) | 0.5(A) | 0.5(A) | 0.6(A) | 0.5(A) | 1.4(C) |
| | | | Density | 1.42(B) | 1.49(A) | 1.43(B) | 1.38(C) | 1.40(B) | 1.39(C) | 1.48(A) | 1.49(A) | 1.50(A) | 1.48(A) |
| | | After 5000-sheet endurance | SHH fogging | 0.8(A) | 0.6(A) | 1.6(C) | 1.0(B) | 0.9(A) | 0.7(A) | 0.7(A) | 0.7(A) | 0.6(A) | 1.8(C) |
| | | | Density | 1.39(C) | 1.48(A) | 1.40(B) | 1.36(C) | 1.37(C) | 1.36(C) | 1.46(A) | 1.48(A) | 1.49(A) | 1.46(A) |
| | | | Soiling of components | A | A | A | A | A | A | A | A | A | A |
| | | | Density difference in continuous printing D(1-10) | 0.11(C) | 0.01(A) | 0.04(A) | 0.04(A) | 0.04(A) | 0.04(A) | 0.02(A) | 0.02(A) | 0.02(A) | 0.03(A) |
| Low-temperature offset finish temperature | | | | 105 | 105 | 105 | 105 | 105 | 105 | 105 | 105 | 105 | 105 |

TABLE 10

| | | | | Comparative toner 1 | Comparative toner 2 | Comparative toner 3 | Comparative toner 4 | Comparative toner 5 | Comparative toner 6 | Comparative toner 7 | Comparative toner 8 | Comparative toner 9 | Comparative toner 10 |
|---|---|---|---|---|---|---|---|---|---|---|---|---|---|
| Heat resistance | | | Storage stability (50° C./15 day) | C | C | D | D | C | B | E | C | F | B |
| | | | Long-term storage stability (45° C./95% 3 months) | E | E | E | E | D | D | E | C | F | E |
| Environmental stability | NN | Initial | NN fogging | 0.8(A) | 1.0(B) | 1.2(B) | 1.2(B) | 1.0(B) | 1.0(B) | 1.6(C) | 6.7(F) | 4.5(F) | 0.5(A) |
| | | | Density | 1.41(B) | 1.40(B) | 1.37(C) | 1.39(C) | 1.40(B) | 1.42(B) | 1.41(B) | 0.89(F) | 0.67(F) | 1.41(B) |
| | | After 5000-sheet endurance | NN fogging | 0.9(A) | 1.2(B) | 1.4(B) | 1.4(B) | 1.2(B) | 1.2(B) | 1.7(C) | 6.9(F) | 3.9(F) | 1.2(B) |
| | | | Density | 1.38(C) | 1.37(C) | 1.34(C) | 1.37(C) | 1.38(C) | 1.38(C) | 1.37(C) | 0.80(F) | 0.63(F) | 1.38(C) |
| | | | Soiling of components | A | A | A | A | A | A | A | C | F | A |
| | LL | Initial | LL fogging | 1.1(B) | 1.5(C) | 1.6(C) | 1.1(B) | 1.7(C) | 1.1(B) | 1.7(C) | 7.5(F) | 6.7(F) | 1.0(B) |
| | | | Density | 1.39(C) | 1.38(C) | 1.38(C) | 1.37(C) | 1.33(C) | 1.40(B) | 1.42(B) | 0.72(F) | 0.59(F) | 1.40(B) |
| | | After 5000-sheet endurance | LL fogging | 1.3(B) | 1.7(C) | 1.9(C) | 1.3(B) | 1.8(C) | 1.3(B) | 1.9(C) | 7.0(F) | 7.1(F) | 1.3(B) |
| | | | Density | 1.37(C) | 1.36(C) | 1.35(C) | 1.35(C) | 1.31(C) | 1.37(C) | 1.39(C) | 0.68(F) | 0.46(F) | 1.37(C) |
| | | | Soiling of components | B | B | B | B | B | B | B | C | F | B |
| | SHH after left to stand in severe environment for 48 hours | Initial | SHH fogging | 2.5(E) | 2.6(E) | 2.7(E) | 2.2(D) | 2.6(E) | 2.0(D) | 2.5(E) | 10.8(F) | 11.7(F) | 2.5(E) |
| | | | Density | 1.30(C) | 1.29(D) | 1.29(D) | 1.29(D) | 1.24(D) | 1.34(C) | 1.20(F) | 0.51(F) | 0.42(F) | 1.29(D) |
| | | After 5000-sheet endurance | SHH fogging | 2.8(E) | 2.8(E) | 3.2(F) | 2.5(E) | 2.8(E) | 2.3(D) | 2.9(E) | 11.9(F) | 13.5(F) | 2.9(E) |
| | | | Density | 1.27(D) | 1.26(D) | 1.25(D) | 1.26(D) | 1.21(E) | 1.31(C) | 1.16 (F) | 0.42(F) | 0.38(F) | 1.25(D) |
| | | | Soiling of components | D | D | D | D | D | D | E | F | F | D |
| | | | Density difference in continuous printing D (1-10) | 0.17(D) | 0.19(D) | 0.22(E) | 0.20(E) | 0.18(D) | 0.16(D) | 0.24(E) | 0.18(D) | 0.16(D) | 0.16(D) |
| Low-temperature offset finish temperature | | | | 105 | 105 | 105 | 115 | 115 | 115 | 115 | 115 | 105 | 110 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-131705, filed Jun. 26, 2014 and Japanese Patent Application No. 2014-136334, filed Jul. 1, 2014, which are hereby incorporated by reference herein in their entirety.

What is claimed is:

1. A method for producing toner particles each of which has a surface layer, the surface layer containing an organosilicon polymer, wherein the method comprises a step of forming the surface layer by providing an aqueous medium containing base particles, mixing an organosilicon compound and the aqueous medium, and polymerizing the organosilicon compound at a temperature of from 80.0° C. or more and 105.0° C. or less, wherein the organosilicon compound is represented by the following formula (1) or (2):

(1)

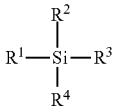

wherein $R^1$, $R^2$, $R^3$, and $R^4$ independently denote a hydrogen atom, a halogen atom, a hydroxy group, an amino group, or an alkoxy group, (2)

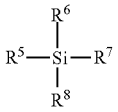

wherein $R^5$ denotes an alkyl group, an alkenyl group, or a phenyl group, and $R^6$, $R^7$, and $R^8$ independently denote a hydrogen atom, a halogen atom, a hydroxy group, an amino group, or an alkoxy group.

2. The method for producing toner particles according to claim 1, wherein the organosilicon compound is polymerized at an aqueous medium temperature of 85.0° C. or more and 100.0° C. or less.

3. The method for producing toner particles according to claim 1, wherein the base particles are one of the following particles A, particles B, particles C, and particles D:

(A) particles A produced by forming a polymerizable monomer composition containing a polymerizable monomer in an aqueous medium and polymerizing the polymerizable monomer composition;

(B) particles B produced by melt-kneading and grinding a binder resin;

(C) particles C produced by forming a dispersion liquid containing an organic phase dispersed in an aqueous medium, the organic phase containing a binder resin and an organic solvent; and (D) particles D produced by agglomerating binder resin particles in an aqueous medium.

4. The method for producing toner particles according to claim 1, wherein the organosilicon compound is polymerized while the aqueous medium is maintained at a pH of 4.0 or more and 10.0 or less.

5. The method for producing toner particles according to claim 1, wherein the organosilicon compound is represented by the formula (2), and $R^5$ in the formula (2) denotes an alkyl group having 6 or less carbon atoms, an alkenyl group having 6 or less carbon atoms, or a phenyl group.

6. The method for producing toner particles according to claim 5, wherein $R^5$ in the formula (2) denotes a methyl group, an ethyl group, a propyl group, or a phenyl group.

7. The method for producing toner particles according to claim 1, wherein the organosilicon compound is represented by the formula (2), and $R^6$, $R^7$, and $R^8$ in the formula (2) independently denote a methoxy group or an ethoxy group.

8. The method for producing toner particles according to claim 1, wherein a ratio of NTX to NSi is 50% or more and 100% or less, NTX being a total number of silicon atoms in partial structures of the organosilicon polymer represented by the following formulae (TX1) to (TX3), NSi being a total number of silicon atoms in the organosilicon polymer:

(TX1)

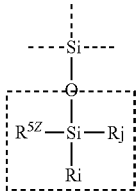

wherein Ri and Rj independently denote a hydrogen atom, a halogen atom, a hydroxy group, an amino group, or an alkoxy group, and $R^{5Z}$ denotes an alkyl group, an alkenyl group, a polymer of the alkenyl group, or a phenyl group, (TX2)

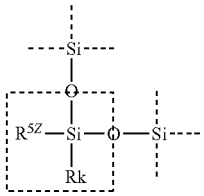

wherein Rk denotes a hydrogen atom, a halogen atom, a hydroxy group, an amino group, or an alkoxy group, and $R^{5Z}$ denotes an alkyl group, an alkenyl group, a polymer of the alkenyl group, or a phenyl group, and (TX3)

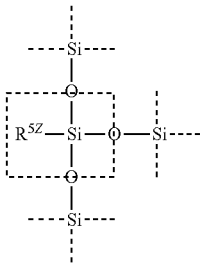

wherein $R^{5Z}$ denotes an alkyl group, an alkenyl group, a polymer of the alkenyl group, or a phenyl group.

* * * * *